US005182583A

United States Patent [19]

Horigome et al.

[11] Patent Number: 5,182,583

[45] Date of Patent: Jan. 26, 1993

[54] INK-JET HAVING BATTERY CAPACITY DETECTION

[75] Inventors: Hideo Horigome, Tokyo; Junichi Arakawa, Yokohama, both of Japan

[73] Assignee: Canon Kabushiki Kaisha, Tokyo, Japan

[21] Appl. No.: 730,096

[22] Filed: Jul. 15, 1991

[30] Foreign Application Priority Data

Jul. 17, 1990 [JP] Japan ..... 2-189245
Jul. 17, 1990 [JP] Japan ..... 2-189247

[51] Int. Cl.[5] ..... B41J 2/165; B41J 2/05

[52] U.S. Cl. ..... 346/140 R; 324/429; 340/636; 346/146; 400/54

[58] Field of Search ..... 346/140 R, 146, 1.1; 400/54, 88; 324/429; 340/636

[56] References Cited

U.S. PATENT DOCUMENTS 4,052,717 10/1977 Arnold ..... 340/636 X
4,313,124 1/1982 Hara .
4,345,262 8/1982 Shirato et al. .
4,450,454 5/1984 Koto ..... 346/140 R
4,459,600 7/1984 Sato et al. .
4,463,359 7/1984 Ayata et al. .
4,558,333 12/1985 Sugitani et al. .
4,646,111 2/1987 Shimosato ..... 346/140 R
4,665,370 5/1987 Holland ..... 324/429
4,723,129 2/1988 Endo et al. .
4,740,796 4/1988 Endo et al. .

FOREIGN PATENT DOCUMENTS 0355461 2/1990 European Pat. Off. .
0369782 5/1990 European Pat. Off. .
59-91085 5/1984 Japan .
59-123670 7/1984 Japan .
59-138461 8/1984 Japan .
61-248772 11/1986 Japan .

*Primary Examiner*—Joseph W. Hartary
*Attorney, Agent, or Firm*—Fitzpatrick, Cella, Harper & Scinto

[57] ABSTRACT

An ink jet recording apparatus to which a power source is supplied from a battery and which executes the recording onto a recording sheet by using a recording head which discharges an ink from a discharge port comprises: a battery detector to detect run-down in battery capacity of the battery on the basis of a voltage of the battery; a capping device to cover the discharge port of the recording head; a load control circuit to apply a load to the battery for a predetermined period of time just before the capping device releases the covering of the discharge port of the recording head; a detection control circuit for allowing the battery detector to detect the voltage for the predetermined period of time; and a motor to relatively move the recording head and the recording sheet. The load control circuit applies the load to the battery by supplying the power source from the battery to the motor for the predetermined period of time.

50 Claims, 14 Drawing Sheets

FIG. 5A
FIG. 5
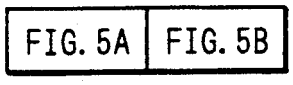
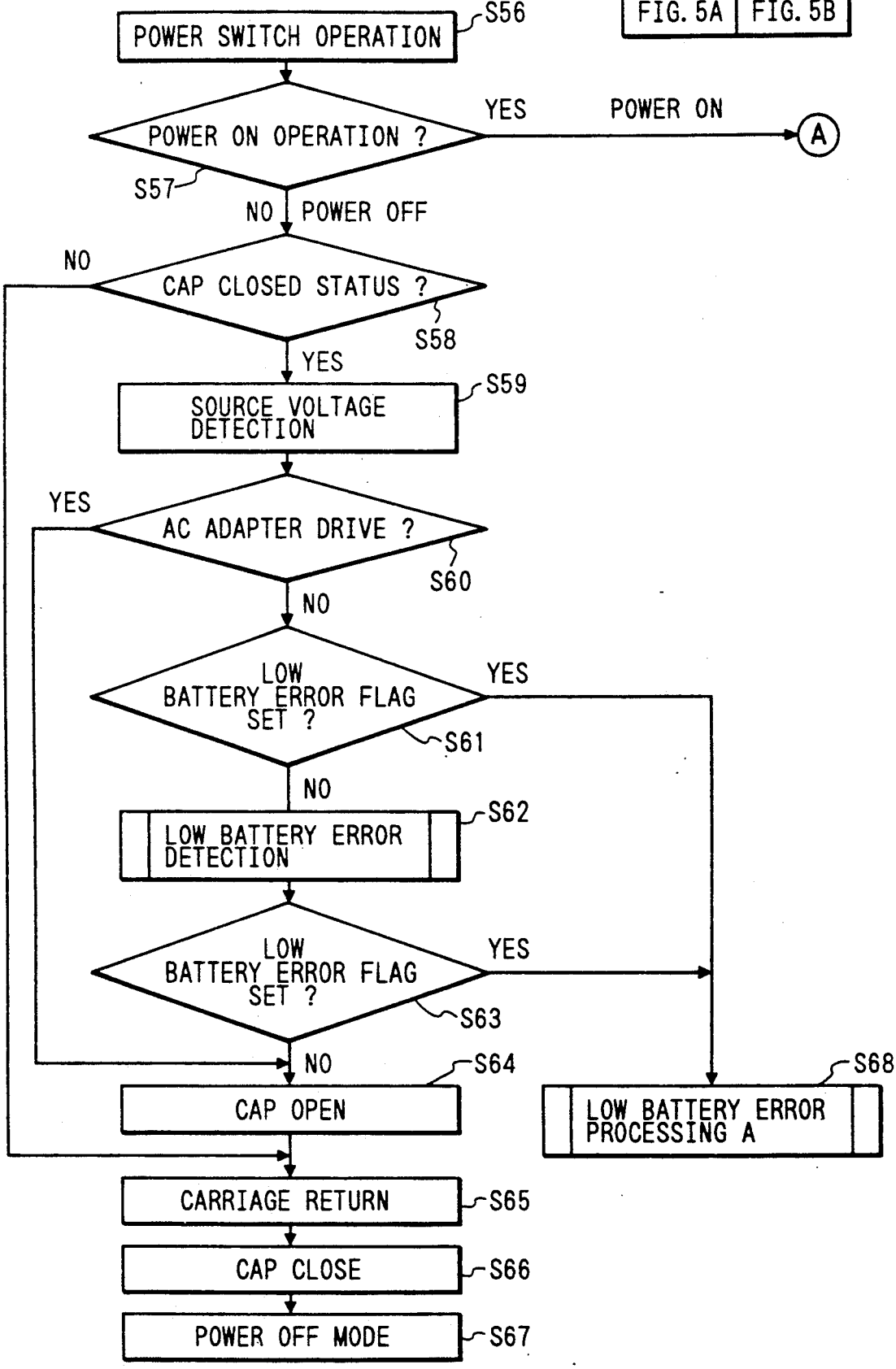

FIG. 6A
FIG. 6
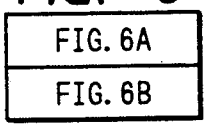
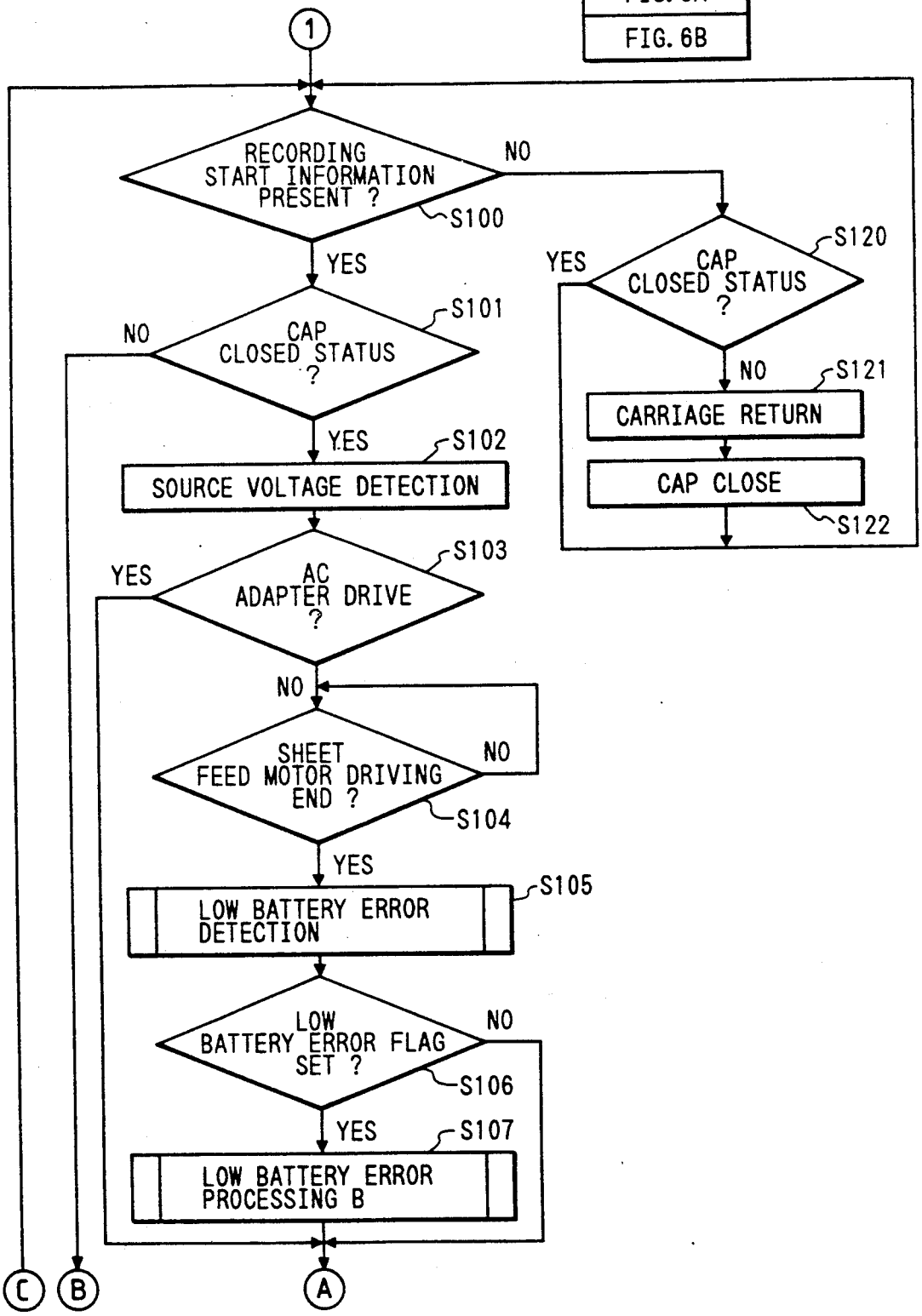

A
B
C
CAP OPEN
S108
CARRIAGE MOTOR DRIVING START
S109
ONE LINE RECORDING
S110
SOURCE VOLTAGE DETECTION
S111
AC ADAPTER DRIVE ?
NO
S112
YES
LOW BATTERY ALARM DETECTION
S119
CARRIAGE MOTOR DECELERATION DRIVE
S113
CARRIAGE MOTOR DRIVE END
S114
LOW BATTERY ALARM FLAG SET ?
NO
S115
YES
S116
LOW BATTERY ALARM PROCESSING
YES
IS SHEET SET ?
S117
NO
S118
NO SHEET ERROR

INK-JET HAVING BATTERY CAPACITY DETECTION

BACKGROUND OF THE INVENTION

1. Field of the Invention

The invention relates to a recording apparatus which can be driven by a battery and, more particularly, to an ink jet recording apparatus.

2. Description of the Related Background Art

A printing recording apparatus of a printer, a facsimile apparatus, or the like is constructed in such a manner that an image comprising a dot pattern is recorded onto a recording sheet such as paper, thin plastics plate, or the like by driving an energy generating element of a recording head on the basis of image information which is transferred.

The above recording apparatus can be classified into an ink jet type, a wire dot type, a thermal type, and the like in dependence on recording methods. Among them, in the ink jet type (ink jet recording apparatus), a recording liquid (ink) droplet is discharged from a discharge port of the recording head and is allowed to fly and the droplet is deposited onto a material such as a paper or the like to be recorded, thereby recording.

In the ink jet recording apparatus of the type using heat as an ink droplet discharging energy, a discharge port is formed in the front surface of the recording head, that is, the surface which faces the material to be recorded and a liquid channel communicating from a common liquid chamber to the discharge port is formed in the recording head. A current is supplied to an electrothermal converting element such as a resistor or the like arranged on the liquid channel and the ink is heated, so that a state change which is accompanied with a sudden volume increase such as a generation of a bubble or the like due to a film boiling is caused in the ink, thereby discharging an ink droplet from the discharge port and allowing the ink droplet to fly. The above recording apparatus has excellent features such that a size of electrothermal converting element is extremely smaller than a piezoelectric transducing element which is used in a conventional ink jet recording apparatus, a large number of discharging ports can be installed as a multi-discharge port at a high density, a recording image of a high quality is derived, a recording speed is high, noises are low, and the like.

In the ink jet recording apparatus, if the ink discharge port of the recording head is opened toward the atmosphere for a long time in a state in which no recording is performed, a solvent component such as water, volatile organic solvent, or the like is evaporated into the atmosphere through the ink discharge port from the inks remaining in the ink discharge port and a portion around it because the ink is the water ink. Thus, viscosities of the inks remaining in the ink discharge port and a portion therearound increase and exceed a range suitable for the ink discharge. Therefore, a defective discharge such that no ink droplet is discharged even if a discharge signal has been applied just after the restart of the recording easily occurs.

On the other hand, if a vibration has been applied to the apparatus in a non-recording state, the ink leaks into the apparatus from the ink discharge port in spite of the fact that no discharge signal is applied. Therefore, problems such that the parts in the apparatus corrode and the like occur. Particularly, a small ink jet recording apparatus is often used as a portable apparatus. If the apparatus is moved or carried without sealing and closing the ink discharge port, a situation such that the ink which has leaked from the ink discharge port is scattered out of the apparatus can be also caused.

In the ink jet recording apparatus, therefore, a cap member is provided in order to isolate the ink discharge port from the atmosphere when no recording is performed. In the non-recording state, the cap member is driven by a motor or the like and is come into contact with the ink discharge port surface of the recording head. In the ink jet recording apparatus, particularly, in the small ink jet recording apparatus which is considered as a type for a portable use, it is necessary to certainly seal and close the ink discharge port by the cap member in the non-recording state because of the above reason.

Although the recording apparatus generally uses a commercially available power source as a main power source, in the case of a portable small recording apparatus, a two-source type comprising an AC adapter and a battery is frequently used.

In the case of driving the recording apparatus by a battery, however, an output voltage of the battery drops when a residual capacity of the battery decreases, so that it is difficult to drive each section in the apparatus. For instance, a situation such that the received recording information is lost if the function is suddenly stopped during the recording operation can be caused. In the case of the ink jet recording apparatus, a situation such that the ink discharge port of the recording head cannot be sealed and closed by the cap member can be caused.

In the case of driving the recording apparatus, particularly, the ink jet recording apparatus powered by a battery, it is necessary to use means for monitoring a battery capacity and means for protecting the apparatus when the battery capacity has decreased to a predetermined value or less.

In the electronic apparatus which can be driven by the battery, there is widely used a method of presuming the battery capacity by detecting the battery voltage by using a discharging characteristic such that the battery voltage drops with a decrease in battery capacity. In the ink jet recording apparatus as well, hitherto, the battery voltage is always detected and when it has dropped to a predetermined voltage, the lack of battery capacity is determined and the operation of the apparatus is interrupted and the lack of battery capacity is informed to the operator by a buzzer or a display device such as a lamp or the like.

The recording head is generally mounted on a carriage which is reciprocated in the horizontal direction by a carriage motor. The material to be recorded is conveyed in the direction perpendicular to the reciprocating directions of the carriage by a conveying roller which is driven by a sheet feed motor.

The conventional apparatuses, however, have the following drawbacks because the battery capacity is detected at an arbitrary timing.

Since a discharge current during the recording operation has a pulse waveform, the battery voltage also changes like a pulse in accordance with the discharge current. Further, the pulse waveform is set to an arbitrary pattern during the recording operation because an energy which is required to discharge an ink droplet and driving conditions of the carriage motor, sheet feed motor, and the like differ depending on an image to be recorded.

In the conventional apparatus, therefore, there is a technical subject such that a discriminating precision of the battery capacity deteriorates because the discharging conditions of the battery upon detection of the battery voltage change each time the battery voltage is detected. Therefore, there is a possibility such that the recording operation is continued in a state in which a lack of battery capacity cannot be detected. A situation such that the function of the apparatus is stopped during the recording of an image and the received recording information is extinguished can be caused. Or, in the case of the ink jet recording apparatus, a situation such that the ink discharge port of the recording head is left without being sealed and closed can be also caused.

To avoid such situations, it is necessary to select a discharge end voltage to be a relatively high value. However, the limited battery capacity cannot be effectively used and it is impossible to avoid a situation such that the driving time by the battery decreases.

The conventional apparatus in which the battery voltage is detected at an arbitrary timing, further, has the following drawbacks.

The battery voltage gradually rises just after the decrease in discharge current as in the case just after the operating mode has shifted from the recording mode to the standby mode. It takes about tens of seconds until the battery voltage is balanced although it differs in dependence on the discharging conditions before the operating mode is shifted to the standby mode. Therefore, the detection voltage value changes with the elapse of time in the standby mode and the discriminating precision of the battery capacity deteriorates. Thus, a situation such that the lack of battery capacity cannot be detected and the function of the apparatus is stopped can be also caused. To avoid such a situation, it is necessary to select the discharge end voltage to a relatively high value as mentioned above. However, the limited battery capacity cannot be effectively used and the driving time of the apparatus decreases.

Therefore, a method of detecting the battery voltage after waiting for a period of time which is required until the battery voltage is balanced is considered in the standby mode. According to the above method, however, even in the case where the recording information sent from a host apparatus just after the operating mode was shifted to the standby mode has been received as well, it is necessary to wait for a time until the battery voltage is balanced. Therefore, a throughput of the recording apparatus deteriorates.

On the contrary, a method of detecting the battery voltage only just after the operating mode was shifted to the standby mode is also considered. According to the above method, however, the following situation is also considered. That is, at a time point of the detection of the battery voltage, even if a battery capacity of a predetermined value or more remains, in the case where the standby mode had continued as it is for a long time such as 30 minutes, the battery capacity has already been smaller than the predetermined value when the recording information was received and the recording operation was started, so that the apparatus stops the function just after the start of the recording operation.

Furthermore, a method of a combination of the above two methods is also considered. That is, a battery voltage is first detected just after the operating mode was shifted to the standby mode and in the case where the standby mode has continued even after the elapse of a predetermined time which is required until the battery voltage is balanced, the battery voltage is always detected. According to such a combination method, however, a discharge end voltage is independently set for each of the case just after the operating mode was shifted to the standby mode and the case where the battery voltage approaches a balanced state, so that a burden of the software increases. In addition to the above problem, a change amount until the battery voltage reaches a balanced state differs due to a residual capacity of the battery or the discharging conditions before the operating mode is shifted to the standby mode. Therefore, it is actually impossible to balance and set the two or more discharge end voltage values so as not to cause a mutually contradictory judgment.

SUMMARY OF THE INVENTION

The invention, therefore, is made to solve the foregoing problems and it is a main object of the invention to provide a recording apparatus which can detect a battery capacity at a high accuracy.

Another object of the invention is to provide a recording apparatus capable of preventing the battery from being run down during the operation.

Still another object of the invention is to provide an ink jet recording apparatus capable of preventing the battery from being run down in a noncapping state.

To accomplish the above objects, according to the invention, there is disclosed an ink jet recording apparatus to which a power source is supplied from a battery and which records onto a recording medium by using a recording head which discharges an ink from a discharge port, comprising: battery detecting means for detecting run-down or go-down in battery capacity of the battery on the basis of a voltage of the battery; capping means for capping the discharge port of the recording head; load control means for applying a load to the battery for a predetermined period of time just before the capping means cancels the capping of the discharge port of the recording head; and detection control means for allowing the battery detecting means to execute the voltage detection for the predetermined period of time.

To accomplish the above objects, according to another aspect of the invention, there is disclosed a recording apparatus to which a power source is supplied from a battery and which records onto a recording medium by using a recording head, comprising: battery detecting means for detecting go-down in battery capacity of the battery on the basis of a voltage of the battery; a motor for relatively moving the recording head and the recording medium; and detection control means for allowing the battery detecting means to execute the voltage detection for an acceleration or deceleration period of time of the motor.

To accomplish the above objects, according to yet another aspect of the invention, there is disclosed an ink jet recording apparatus to which a power source is supplied from a battery and which records onto, a recording medium by using a recording head which discharge ink from a discharge port, comprising: battery detecting means for detecting a go-down in battery capacity of the battery on the basis of a voltage of the battery; capping means for capping the discharge port of the recording head; load control means for applying a load to the battery for a predetermined period of time just before the capping means cancels the capping of the discharge port of the recording head; first detection control means for allowing the battery detecting means to execute the voltage detection for the predetermined period of time; a motor for relatively moving the recording head and the recording medium; and second detection control means for allowing the battery detecting means to execute the voltage detection for an acceleration or deceleration period of time of the motor.

BRIEF DESCRIPTION OF THE DRAWINGS

FIG. 5, 5A and 5B are a flowchart showing the operation when a power switch is operated according to the embodiment;

FIGS. 6, 6A and 6B are a flowchart showing the operation upon recording according to the embodiment;

DETAILED DESCRIPTION OF THE PREFERRED EMBODIMENTS

An embodiment in the case where a recording apparatus of the invention has been applied to an ink jet recording apparatus will be described in detail hereinbelow with reference to the drawings.

Figure 6B:
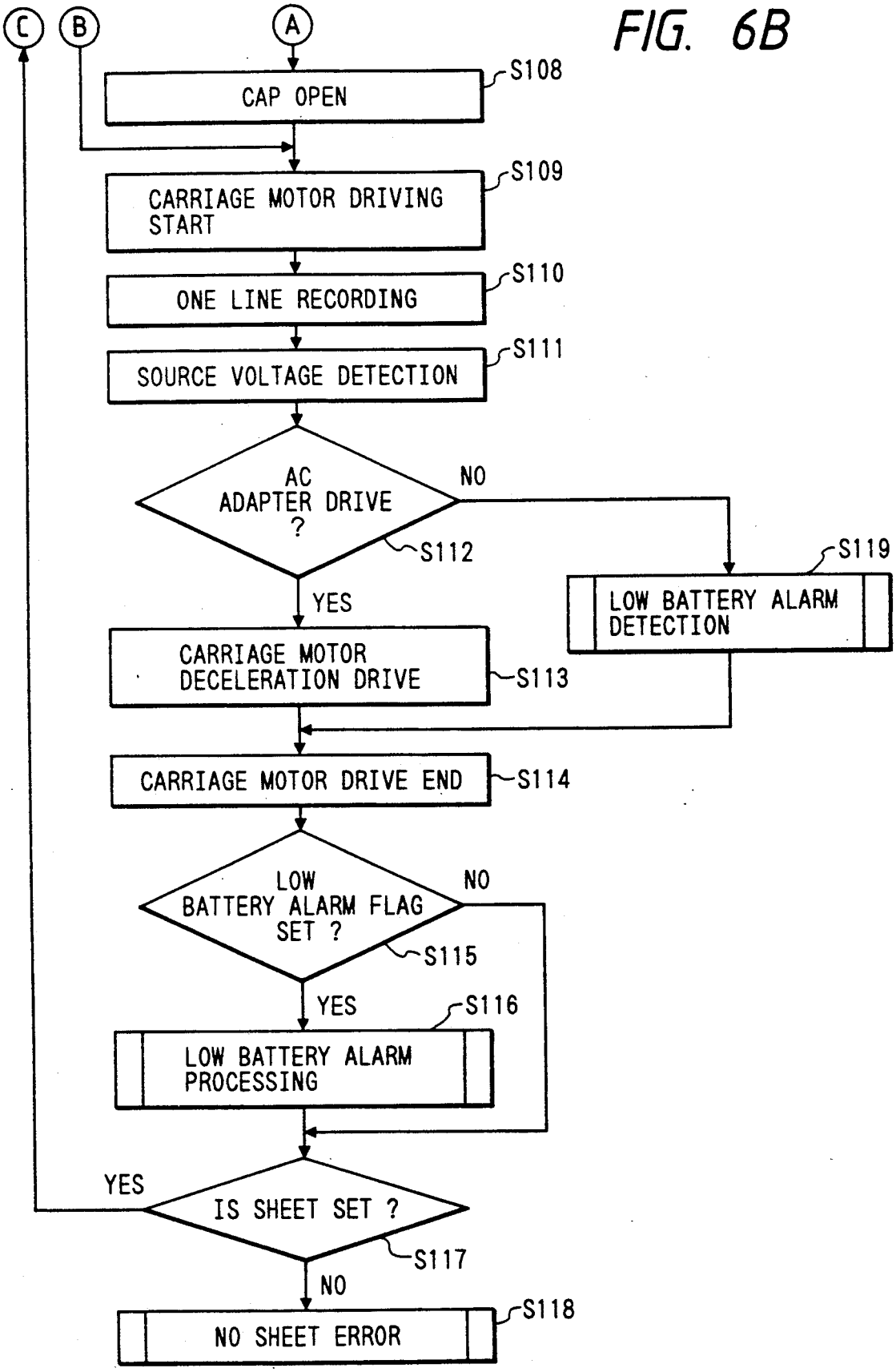
Figure 7:
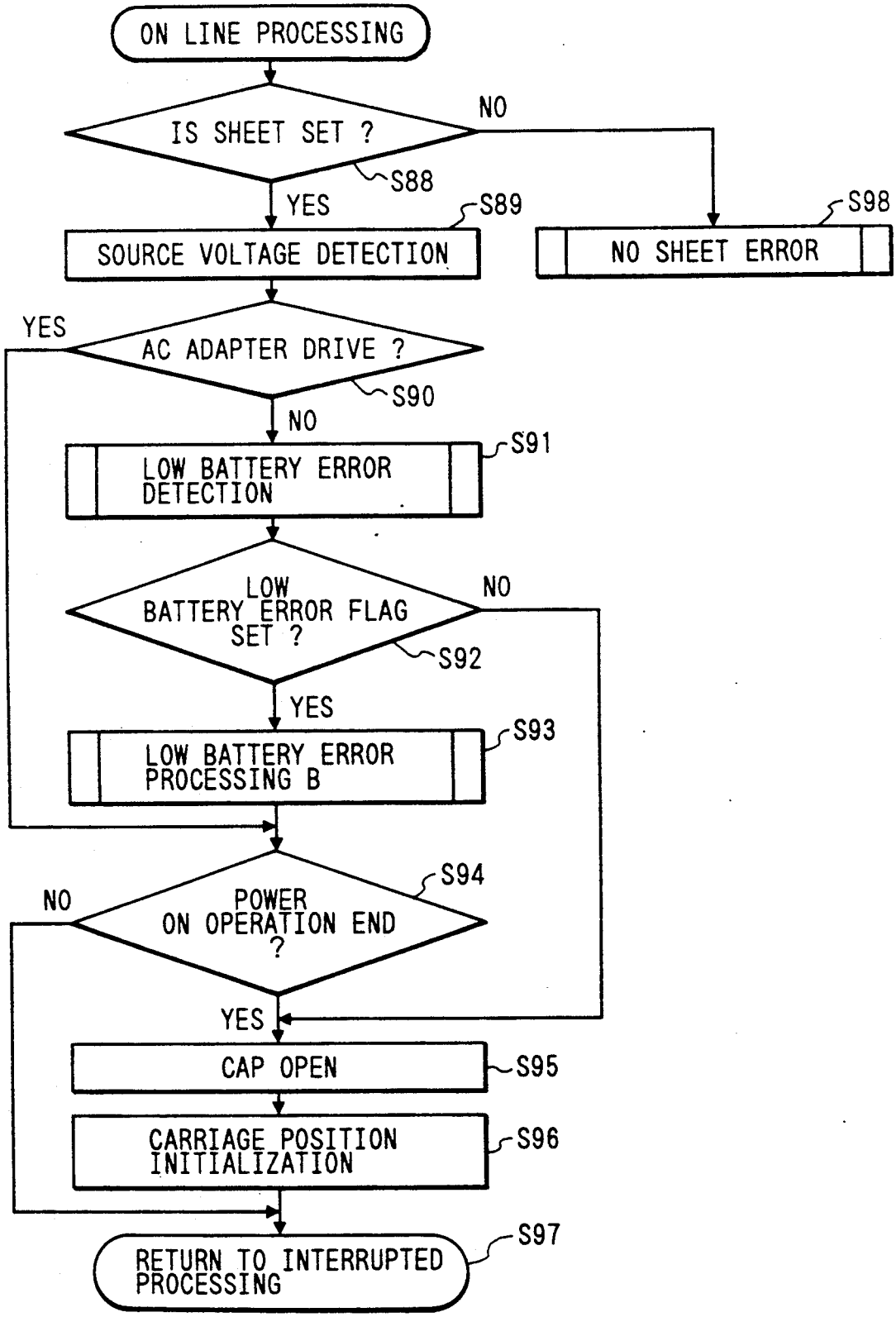
FIG. 7 is a flowchart showing an on-line processing according to the embodiment.
Figure 8:
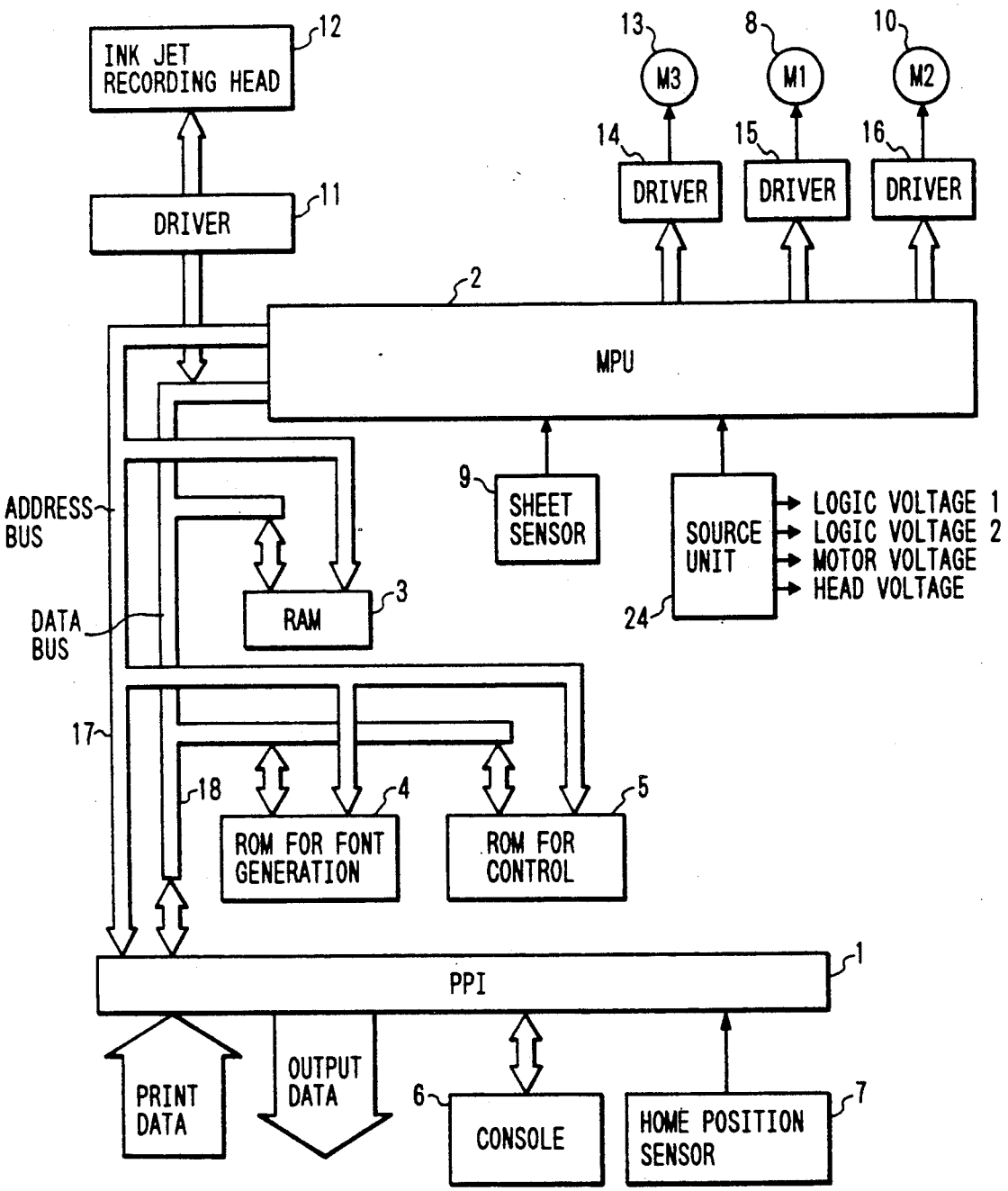
FIG. 8 is a block diagram showing a construction of a control system of the embodiment.

FIGS. 1 to 7 are flowcharts for explaining the control operation of an embodiment according to the invention. FIG. 8 is a block diagram showing an example of a construction of a control system of an ink jet recording apparatus according to the embodiment. The block diagram of FIG. 8 will be first described.

In the diagram, reference numeral 1 denotes a programmable peripheral interface (hereinafter, abbreviated to a PPI). The PPI 1 receives in parallel command signals which are sent from a host computer and a recording information signal and transfers to a microprocessing unit (hereinafter, abbreviated to an MPU) 2. The PPI 1 also controls a console 6 and executes an input processing of a carriage home position sensor 7.

The MPU 2 controls each section in the recording apparatus. Reference numeral 3 denotes an RAM to store the received signals; 4 an ROM for font generation for generating an image such as characters, symbols, or the like; and 5 an ROM for control in which processing procedures (FIGS. 1 to 7) which are executed by the MPU 2 have been stored. The above components are controlled through an address bus 17 and a data bus 18, respectively.

Reference numeral 8 denotes a carriage motor of the stepping type to move a carriage; 10 a sheet feed motor to convey the material to be recorded in the direction perpendicular to the moving direction of the carriage; and 13 a capping motor for driving the cap member so as to come into contact with an ink discharge port (not shown) of a recording head 12, which will be explained hereinlater, thereby isolating the ink discharge port from the atmosphere.

Reference numeral 15 denotes a driver to drive the carriage motor 8; 16 a driver to drive the sheet feed motor 10; and 14 a driver to drive the capping motor 13.

Keyboard switches, indication lamps, and the like are provided for the console 6.

The home position sensor 7 is arranged near the home position of the carriage and detects that the carriage having the recording head 12 has reached the home position. Reference numeral 9 denotes a sheet sensor to detect the presence or absence of the material to be recorded such as a recording sheet or the like, that is, whether the recording sheet has been conveyed to the recording section or not.

Reference numeral 12 denotes the ink jet recording head of the type which uses a heat energy as an ink discharge energy as mentioned above. The recording head 12 has the ink discharge port (not shown) and a heater (not shown) to discharge the ink, and the like. Reference numeral 11 denotes a driver to drive the discharging heater of the recording head 12 in accordance with a recording information signal.

Reference numeral 24 denotes a power source unit to supply a power source to each section. The source unit 24 has an AC adapter and a battery as a driving power source apparatus.

Figure 10:
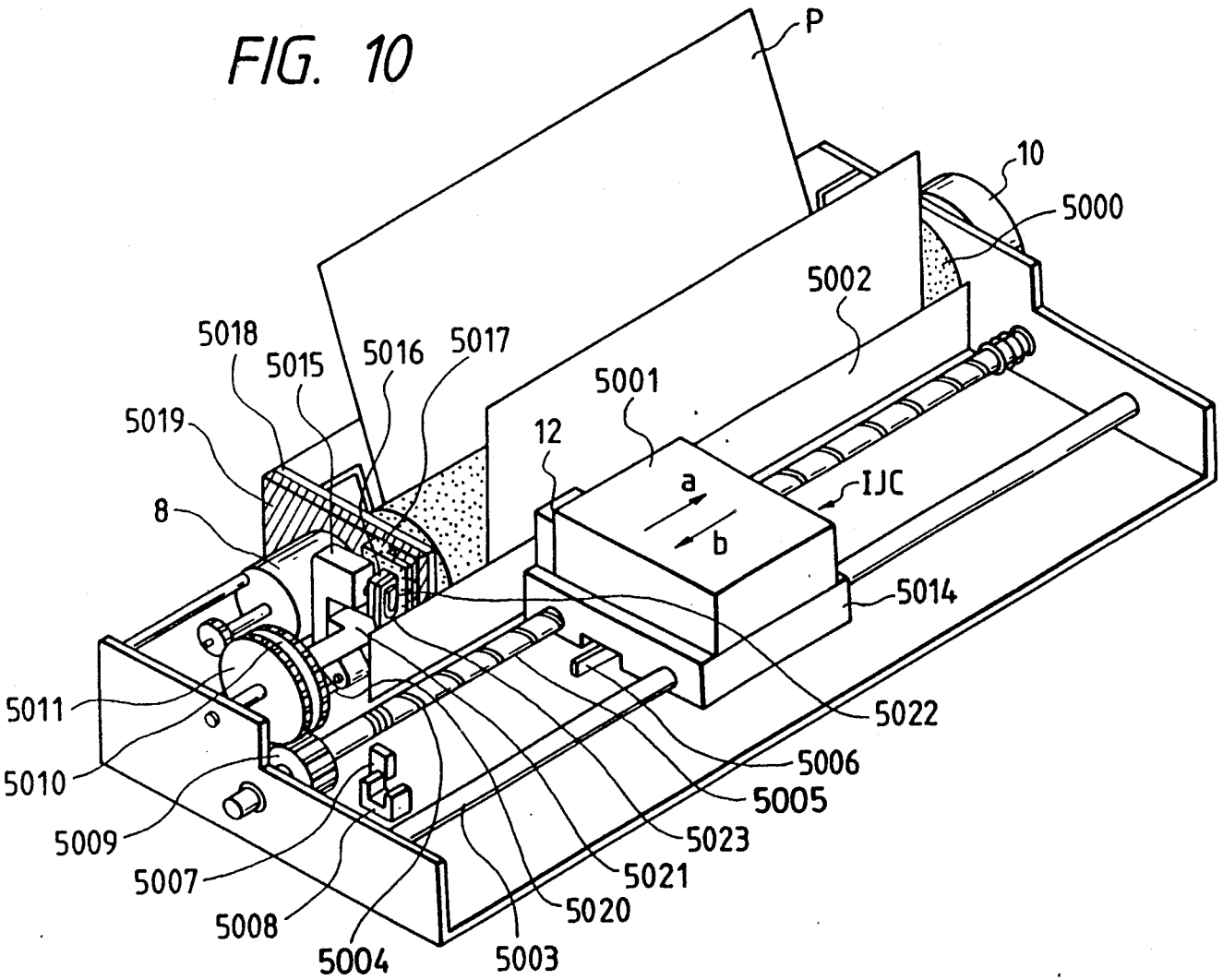
FIG. 10 is a perspective view showing a construction of the embodiment.
Figure 11:
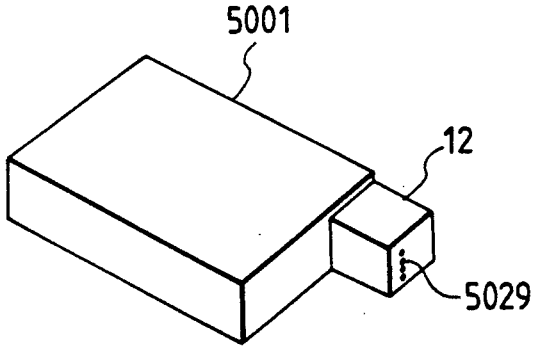
FIG. 11 is a perspective view showing an ink jet cartridge.

FIG. 10 is a perspective view showing a construction of the preferred ink jet recording apparatus to which the invention is embodied or applied. In FIG. 10, reference numeral 5001 denotes an ink tank and 12 indicates the recording head coupled to the ink tank 5001. As shown in FIG. 11, an integrated exchangeable ink jet cartridge IJC is formed by the ink tank 5001 and the recording head 12. Reference numeral 5014 denotes a carriage for attaching the ink jet cartridge IJC to the printer main body and 5003 denotes a guide to scan the carriage 5014 in the main scanning direction.

Reference numeral 5000 denotes a platen roller to scan a material P to be printed such as a recording sheet in the sub scanning direction. The platen roller 5000 is driven by the sheet feed motor 10. A flexible cable (not shown) to supply a signal pulse current for driving the recording head 12 and a current for controlling a temperature of the head to the recording head 12 is connected to a printed circuit board (not shown) attached to the carriage 5014. The printed circuit board has an electrical circuit for controlling the printer.

FIG. 11 shows an exchangeable cartridge. Reference numeral 5029 denotes a nozzle unit to discharge an ink droplet. The ink jet recording apparatus with the above construction will be further described in detail. A lead screw 5005 is rotated in association with the forward-/reverse rotation of the carriage motor 8 through driving force propagating gears 5011 and 5009. The carriage 5014 has a pin (not shown) which is come into engagement with a spiral groove 5004 of the lead screw 5005. Thus, the carriage 5014 as a recording apparatus is reciprocated in the direction indicated by an arrow a or b in association with the forward/reverse rotation of the carriage motor 8. Reference numeral 5002 denotes a sheet pressing plate to press the sheet onto the platen roller 5000 in a range corresponding to the carriage moving direction. Reference numerals 5007 and 5008 denote photo couplers as home position sensing means (home position sensors) for detecting the presence of a lever 5006 of the carriage 5014 in the area of the photo couplers and for switching the rotating direction of the capping motor 13 or the like. Reference numeral 5016 denotes a member for supporting a capping member 5022 to cap the front surface of the recording head. Reference numeral 5015 denotes sucking means for sucking the inside of the cap and for sucking and restoring the recording head 12 through an opening 5023 in the cap. The cap member 5022 is driven by the capping motor 13 (not shown).

Reference numeral 5017 denotes a cleaning blade and 5019 indicates a member for making the cleaning blade 5017 movable in the front/rear direction. The cleaning blade 5017 and the member 5019 are supported to a main body supporting plate 5018. The cleaning blade is not limited to the shape shown in the diagram but a well-known cleaning blade can be applied to the apparatus of the invention. Reference numeral 5021 denotes a lever to start the sucking operation in the sucking/restoring operations. The lever 5021 is moved in association with the movement of a cam 5020 which has come into engagement with the carriage 5014. The driving force from the carriage motor 8 is transmission-controlled by well-known transmission means such as a clutch change-over device or the like.

A desired one of the capping, cleaning, and sucking/restoring processings can be performed at a corresponding position by the operation of the lead screw 5005 when the carriage 5014 has reached the region on the home position side. If a desired one of the above operations is executed at a well-known timing, any one of them can be also applied to the embodiment.

Figure 12:
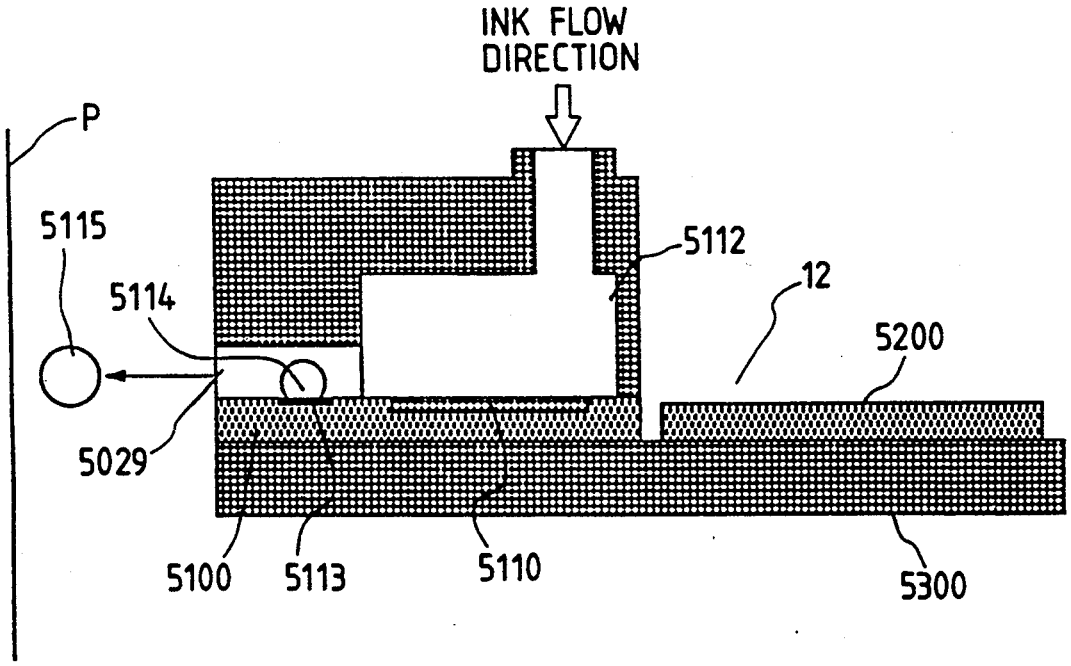
FIG. 12 is a cross sectional view showing a recording head.

FIG. 12 is a diagram showing the recording head 12 in detail. A heater board 5100 formed by a semiconductor manufacturing process is mounted on the upper surface of a supporting member 5300. A temperature adjusting heater (temperature raising heater) 5110 for keeping and controlling a temperature of the recording head 12 is arranged on the heater board 5100. The heater 5110 is formed by the same semiconductor manufacturing process as that of the heater board 5100. Reference numeral 5200 denotes a printed circuit board arranged on the supporting member 5300. The printed circuit board 5200, the temperature adjusting heater 5110, and a discharging (main) heater 5113 are connected by a wire bonding method or the like (connecting wires are not shown). As a temperature adjusting heater 5110, it is also possible to use a construction such that a heater member formed by another process different from that of the heater board 5100 is adhered to the supporting member 5300 or the like.

Reference numeral 5114 denotes a bubble generated by heating the ink by the discharging heater 5113; 5115 an ink droplet discharged from a nozzle portion 5029; and 5112 a common liquid chamber for allowing the discharging ink to flow into the recording head.

In the above construction, the MPU 2 is connected to a host apparatus such as a computer or the like through the PPI 1. The MPU 2 controls the entire recording operation on the basis of the commands and the recording information signal which are sent from the host computer and the processing procedure of the program stored in the control ROM 5 and the recording data stored in the RAM 3.

Figure 9:
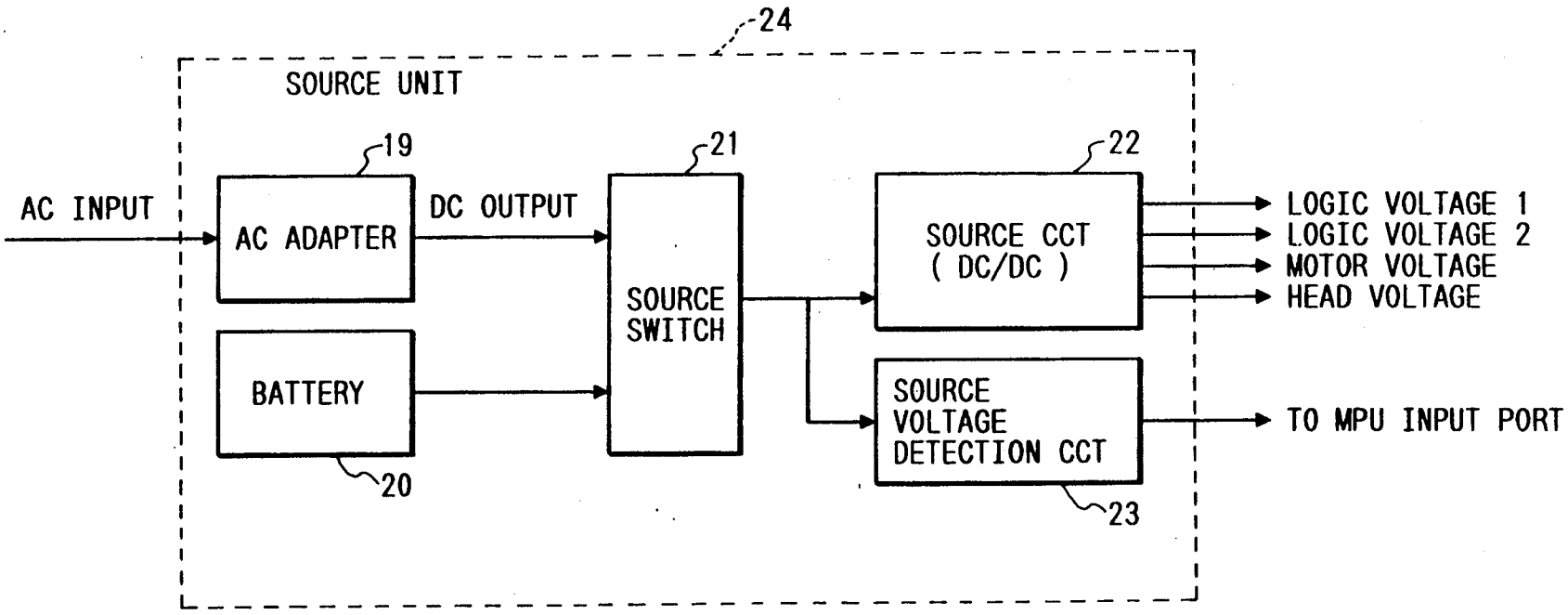
FIG. 9 is a block diagram showing the details of a power source unit in FIG. 8.

The power source unit 24 will now be described in detail hereinbelow with reference to a block diagram of FIG. 9. In the diagram, reference numerals 19 and 20 denote an AC adapter (9.5 V here) and a battery (6 V here) which function as driving power source apparatuses of the ink jet recording apparatus. A chargeable secondary battery such as an Ni-Cd battery or the like is used as a battery 20. Reference numeral 21 denotes a source switch to select either one of the two kinds of driving power source apparatuses. For instance, a source jack is used as a source switch. Reference numeral 23 denotes a source voltage detection circuit for detecting an output voltage of the driving power source apparatus and for sending an output signal to an input port of the MPU 2. In the embodiment, a detection circuit with a simple construction such that the voltage is divided by a resistor and is supplied to the MPU has been used in the embodiment. However, a detection circuit using an A/D converter or a comparator can be also used.

Reference numeral 22 denotes a power source circuit for converting a DC output derived from the driving power source apparatus into a voltage suitable to drive each section in the ink jet recording apparatus. A logic voltage 1 (5 V here) is supplied to the MPU 2 and the voltage is also applied even in a power-off mode. A logic voltage 2 (5 V here) is supplied to logic sections such as an RAM 3 and the like other than the MPU 2. A motor voltage (14 V here) is supplied to the motors 8, 10, and 13. A head voltage (22 V here) is supplied to the recording head 12. The logic voltage 2, the motor voltage, and the head voltage are supplied only in the power-on mode (recording standby mode and recording operating mode).

In the ink jet recording apparatus with the foregoing construction, explanation will now be made with respect to a control procedure by a software for detecting a battery capacity at a high precision and for protecting the received recording data and the recording head in accordance with the result of the detection. An outline will be first explained herein-below.

The control procedure is mainly divided into go-down in battery capacity error detection and processing and go-down in battery capacity alarm detection and processing although the details will be explained hereinlater.

First, it is assumed that go-down in battery capacity error denotes a state in which the battery capacity has already dropped to a level at which the driving of the carriage 5014 and the cap member 5022 cannot be assured. If the recording apparatus is driven in such go-down in battery capacity error state, an inconvenience such that the apparatus ceases to function just after the start of the recording or the like, the received recording data is lost, or the carriage 5014 and the cap member 5022 cannot be driven, and the ink discharge port is held without being sealed and closed can be caused.

Therefore, a residual battery capacity is detected with certainty just be ore the cap member 5022 is released from the ink discharge port (cap opening process) at the start of the recording or the like. If go-down in battery capacity error is detected, the go-down in battery capacity error state is displayed and the cap opening process is stopped, thereby avoiding the above inconvenience. However, to improve the detecting accuracy, the battery capacity is detected by detecting the battery voltage in a state in which a stationary pulse load has been applied to the battery.

It is assumed that go-down in battery capacity alarm denotes a state in which the battery capacity,, has decreased to a level at which completion of the recording operation cannot be assured during the recording operation. If the recording operation is continued in such go-down in battery capacity alarm state, an inconvenience such that the apparatus ceases to function during the recording, the received recording data is lost, or the battery capacity has decreased to a level at which the carriage 5014 and the cap member 5022 cannot be driven, and the ink discharge port of the recording head 12 is left without being sealed and closed can be caused.

Therefore, the residual battery capacity is detected each time one line is recorded during the recording operation. If the go-down in battery capacity alarm is detected, the go-down in battery capacity alarm state is displayed, the recording operation is interrupted, and the ink discharge port is sealed and closed by the cap member 5022 (cap closing process), thereby avoiding the above inconvenience. The battery capacity is detected during the deceleration driving of the carriage motor 8. As reasons of the above operation, there can be mentioned a reason such that such a processing is certainly executed each time one line is recorded and a reason such that the battery capacity can be detected at a high precision because the same discharge current is derived every time different from the case during the ink discharging operation.

In the embodiment, after completion of the go-down in battery capacity error processing, the operation of the apparatus cannot be restarted so long as the AC adapter is not connected by the operator. On the other hand, after completion of the go-down in battery capacity alarm processing, the interrupted recording operation can be restarted if the operator connects the AC adapter or executes the on-line operation. However, if one line has been recorded, the go-down in battery capacity alarm state is again set. Therefore, the recording is eventually restarted one line at a time. This is because by using the battery capacity as efficiently as possible, the number of lines which can be recorded is increased. For instance, such a processing is executed to help a case where the go-down in battery capacity alarm state has been set at a time point when the recording of one page will be finished by merely recording a few remaining lines.

However, the apparatus is designed in a manner such that the go-down in battery capacity alarm control functions in a state in which the residual battery capacity is slightly larger than that in the case of the go-down in battery capacity error control. In the embodiment, therefore, a load current which is applied to the battery upon detection of the battery capacity in the case of the detection of the go-down in battery capacity alarm is set to be slightly larger than that in the case of the detection of the go-down in battery capacity error. A discrimination level of the go-down in battery capacity alarm can be also set to be slightly higher than that of the go-down in battery capacity error.

Figure 1A:
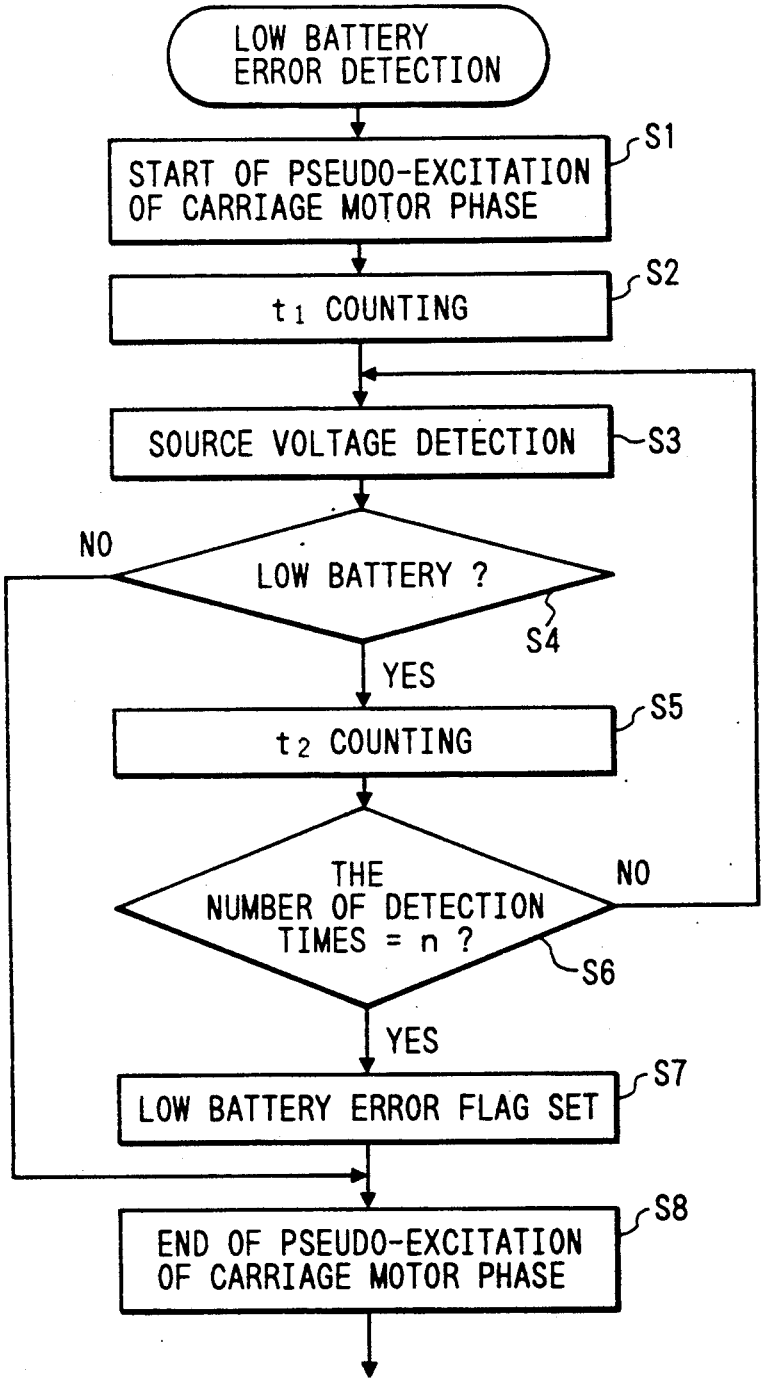
FIGS. 1A and 1B are flowcharts showing the battery detecting operation of an embodiment according to a recording apparatus of the invention.

FIG. 1A is a flowchart showing go-down in battery capacity error detecting procedure of the ink jet recording apparatus of the embodiment. The go-down in battery capacity error detection is performed just before the cap member is released from the ink discharge port surface of the recording head (cap opening process) in order to start to drive the carriage at the start of the recording or the like. On the other hand, the battery capacity is presumed on the basis of the battery voltage.

In FIG. 1A, in step S1, the discharge current of the battery is instantaneously set to a large proper value by a pulse load and in order to detect the battery voltage for such a period of time, the excitation of a carriage motor phase is started, that is, the driving of the carriage motor 8 is started. However, the phase to be excited is not switched so as not to move the carriage 5014. Such an excitation is hereinafter referred to as a pseudo excitation.

By starting the pseudo excitation, the battery voltage drops in an exponential function manner. In step S2, the apparatus waits for a predetermined time $t_1$ (e.g., $t_1=100$ msec) until the battery voltage drop is substantially saturated. In step S3, the battery voltage is detected. The battery voltage is detected by the source voltage detection circuit 23 (FIG. 9) and is converted into the digital value by the A/D converter in the MPU 2 (FIG. 8). In the next step S4, the A/D converted digital value is compared with predetermined go-down in battery capacity threshold value, thereby judging the go-down in battery capacity. For instance, assuming that the converted digital value is less than the battery voltage of 5.7 V, the result of the judgment is YES and the go-down in battery capacity is determined. If it is NO, step S8 follows and the pseudo excitation of the carriage motor phase is finished.

On the other hand, if YES in step S4, in order to prevent an erroneous judgment, the foregoing voltage detecting step S3 and judging step S4 are repeated n times (e.g., $n=3$) at an interval of a predetermined time $t_2$ (e.g., $t_2=5$ msec) (steps S5 and S6). If the results of the judgments of n times are all YES, the processing routine advances to step S7 and go-down in battery capacity error flag is set and the pseudo excitation of the carriage motor phase is finished (step S8).

Although the pseudo excitation of the carriage motor 8 has been executed in FIG. 1A, the pseudo excitation of the sheet feed motor 10 or the capping motor 13 can be also performed in place of the carriage motor. Or, a similar effect is also obtained by a method whereby a current is supplied to the discharging heater in the recording head 12 within a range in which no ink droplet is discharged (for instance, a pulse current of about 3 μsec is repetitively supplied) and the discharge current of the battery is controlled.

Figure 1B:
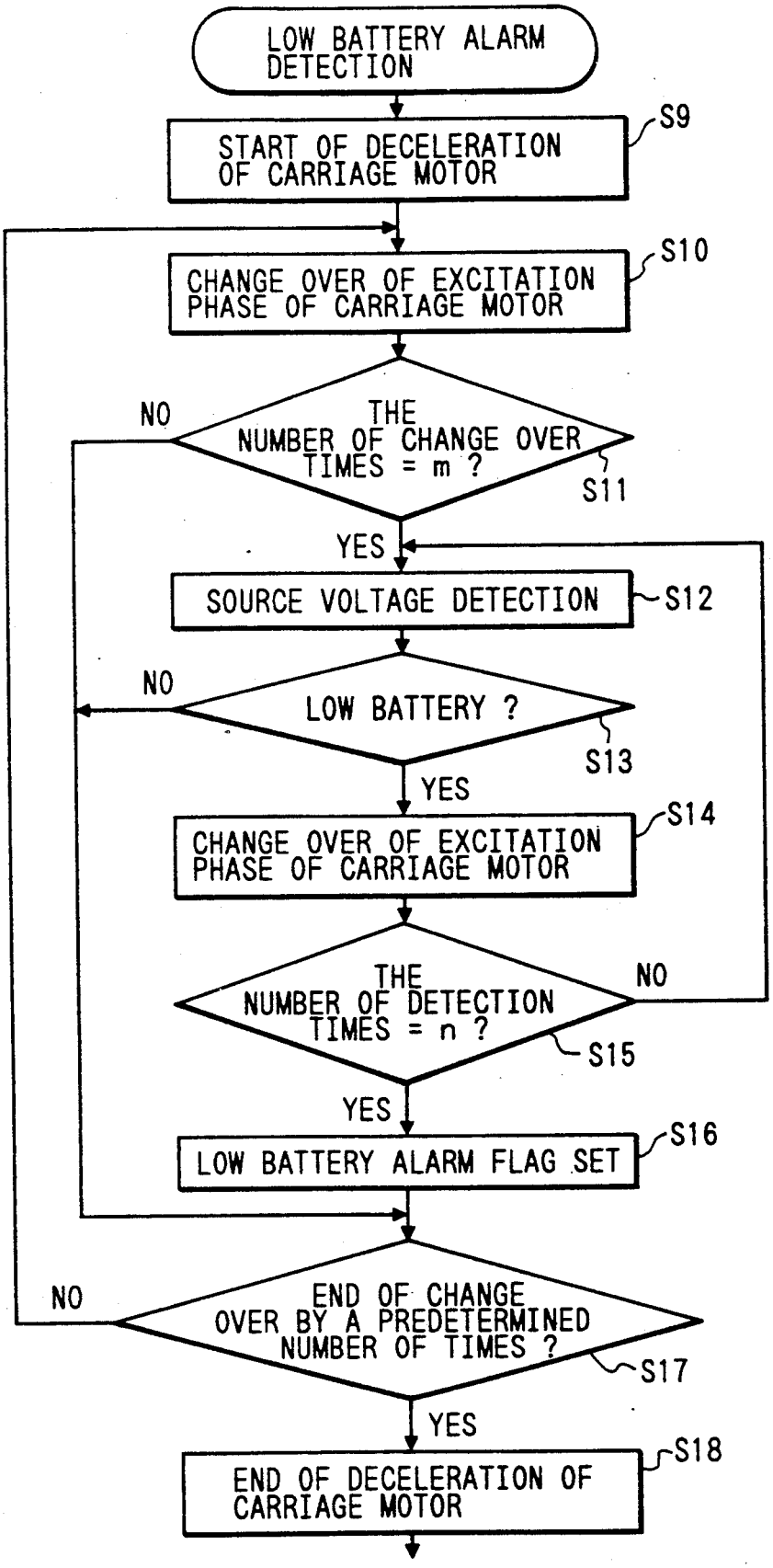

FIG. 1B is a flowchart showing go-down in battery capacity alarm detecting procedure of the embodiment. The go-down in battery capacity alarm is detected during the driving of the carriage motor. The battery capacity is presumed on the basis of the battery voltage.

In FIG. 1B, in step S9, the deceleration of the carriage motor 8 is started to finish the driving of the carriage motor 8. The switching of the excitation phase in the deceleration driving of the carriage motor 8 (step S10) is executed with reference to an acceleration/deceleration table stored in the control ROM (FIG. 8). In step S11, a check is made to see if the number of switching times of the carriage motor excitation phase after the start of the deceleration is equal to a preset number m of times to start the detection of the battery voltage or not. If YES in step S11, the battery voltage is detected in step S12. The battery voltage is detected by the source voltage detection circuit 23 (FIG. 9) and is converted into the digital value by the A/D converter in the MPU 2 (FIG. 8).

The processing routine advances to step S13 and the A/D converted digital value is compared with predetermined go-down in battery capacity threshold value, thereby discriminating the go-down in battery capacity. For instance, if the converted digital value is less than the battery voltage of 5.7 V, the result of step S13 is YES and the go-down in battery capacity is decided. If YES in step S13, step S14 follows and the carriage motor excitation phase is switched in a manner similar to step S10. Further, in order to prevent the erroneous judgment, the foregoing voltage detecting step S12, discriminating step S13, and excitation phase change-over step S14 are repeated n times (e.g., n=3) (step S15).

If the results of the judgments of n times in step S13 are all YES, step S16 follows and go-down in battery capacity alarm flag is set. Then, step S17 follows.

On the contrary, if NO in step S11, the battery voltage detection and the go-down in battery capacity judgment are not executed and a check is made in step S17 to see if the excitation phase change-over of the carriage motor has been executed by only the number of times specified in the carriage motor acceleration/deceleration table or not. If NO in step S17, the processing routine is returned to step S10. If YES in step S17, the deceleration driving of the carriage motor 8 is finished in step S18. If NO in step S13, namely, if the go-down in battery capacity is not detected, the deceleration driving of the carriage motor 8 is similarly performed a predetermined number of times with reference to the carriage motor acceleration/ deceleration table until the carriage motor excitation phase change-over is finished.

Although the go-down in battery capacity alarm has been detected during the deceleration driving of the carriage motor in FIG. 1B, it is also possible to detect the go-down in battery capacity alarm during the carriage motor acceleration driving or during both of the acceleration driving and the deceleration driving of the carriage motor 8.

In FIGS. 1A and 1B, the go-down in battery capacity has been determined in the case where the results of the judgments about the go-down in battery capacity of n times are all YES. However, it is also possible to decide the go-down in battery capacity in the case where the results of the judgments about the go-down in battery capacity of n' times (n'<n) among n times are YES.

As mentioned above, since the go-down in battery capacity alarm has been detected during the driving of the carriage motor 8, a load current which is applied to the battery is larger than that in the case of the go-down in battery capacity error detection which is executed while the carriage motor 8 is stopped, so that the carriage motor operates in a state in which the residual battery capacity is slightly large.

Figure 2A:
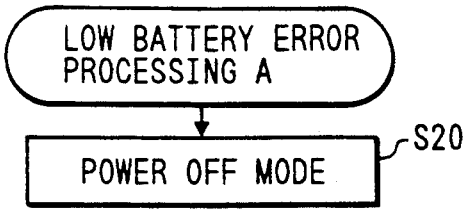
FIGS. 2A, 2B, and 3 are flowcharts showing the operations when a battery is abnormal according to the embodiment.
Figure 2B:
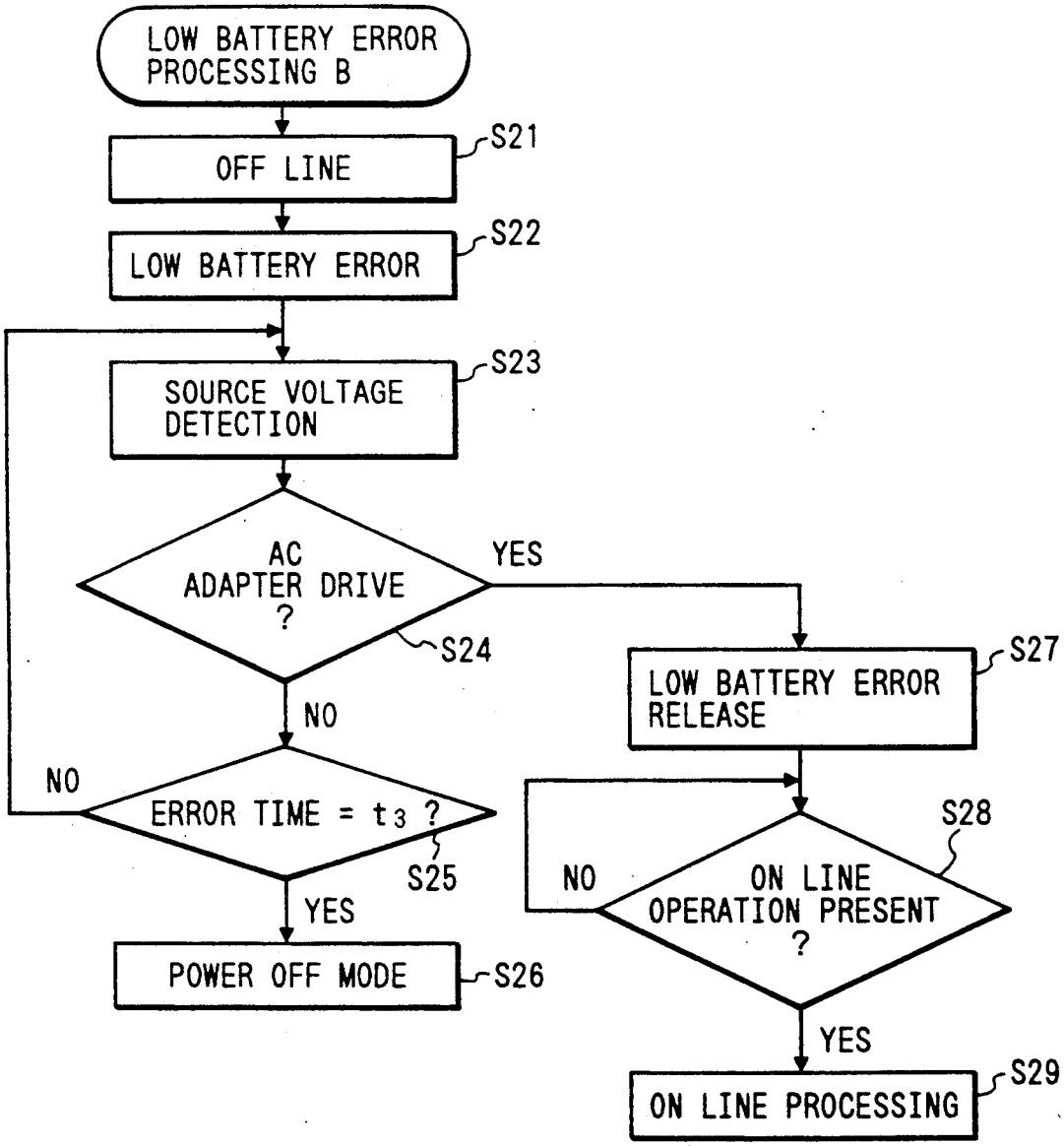

FIGS. 2A and 2B are flowcharts showing go-down in battery capacity error processing procedure of the embodiment. In the case where the go-down in battery capacity error flag has been set to the high level in the go-down in battery capacity error detection (FIG. 1A), the go-down in battery capacity error process is executed.

FIG. 2A shows an A type of the go-down in battery capacity error process. The processing routine jumps the carriage driving process and advances to a power off mode in step S20 in the case where the go-down in battery capacity error flag has been set to the high level although the carriage 5014 should be driven so long as the go-down in battery capacity error flag is not set at the time of turn-on of the power source (FIG. 4) and upon operation of the power-off (FIG. 5) as will be explained hereinlater. In the power-off mode, the apparatus can be set into the power-on mode by a power switching operation, which will be explained hereinlater.

FIG. 2B is the flowchart showing a procedure of the B type of the go-down in battery capacity error process. The go-down in battery capacity error processing B type is executed in the power-on operation (FIG. 5), at the start of the recording (FIG. 6), and in the on-line operation (FIG. 7) as will be explained hereinlater.

In FIG. 2B, the recording apparatus is set into the off-line state in step S21. In the next step S22, an interruption processing from a switch other than the power switch of the console 6 (FIG. 8) is inhibited and the go-down in battery capacity error display state is indicated by an LED lamp, a buzzer, or the like. The go-down in battery capacity error is released by either a method whereby the power source is turned off by operating the power switch or a method whereby the AC adapter is connected and, after that, the on-line operation is executed.

After the go-down in battery capacity error state was set, in step S23, the source voltage is always detected by the source voltage detection circuit 23 (FIG. 9) and is converted into the digital value by the A/D converter of the MPU (FIG. 8). In step S24, the converted value is compared with a predetermined source voltage threshold value, thereby discriminating whether the AC adapter has been connected to the recording apparatus by the operator and the electric power has been supplied from the AC adapter or not. The output voltage of the AC adapter is preset so as to be higher than the output voltage range of the battery. The source voltage threshold value is set so as to decide that the AC adapter has been connected in the case where the converted digital value is equal to or higher than, for example, the source voltage of 7.5 V.

If YES in step S24, that is, if the AC adapter has been connected, step S27 follows and the go-down in battery capacity error display is stopped and the go-down in battery capacity error flag is reset. In the next step S28, the apparatus waits until the on-line operation is executed. If the on-line operation has been performed, the processing routine advances to step S29 and the on-line processing procedure in FIG. 7 is executed. Since the recording data which had been received before the go-down in battery capacity error is generated has been held so far, the recording operation is restarted after completion of the on-line processing.

On the other hand, if the AC adapter is not connected within a predetermined time $t_3$ (e.g., $t_3$=5 minutes) after the go-down in battery capacity error state was set, the processing routine advances from step S25 to step S26 and the power-off mode is set.

Figure 3:
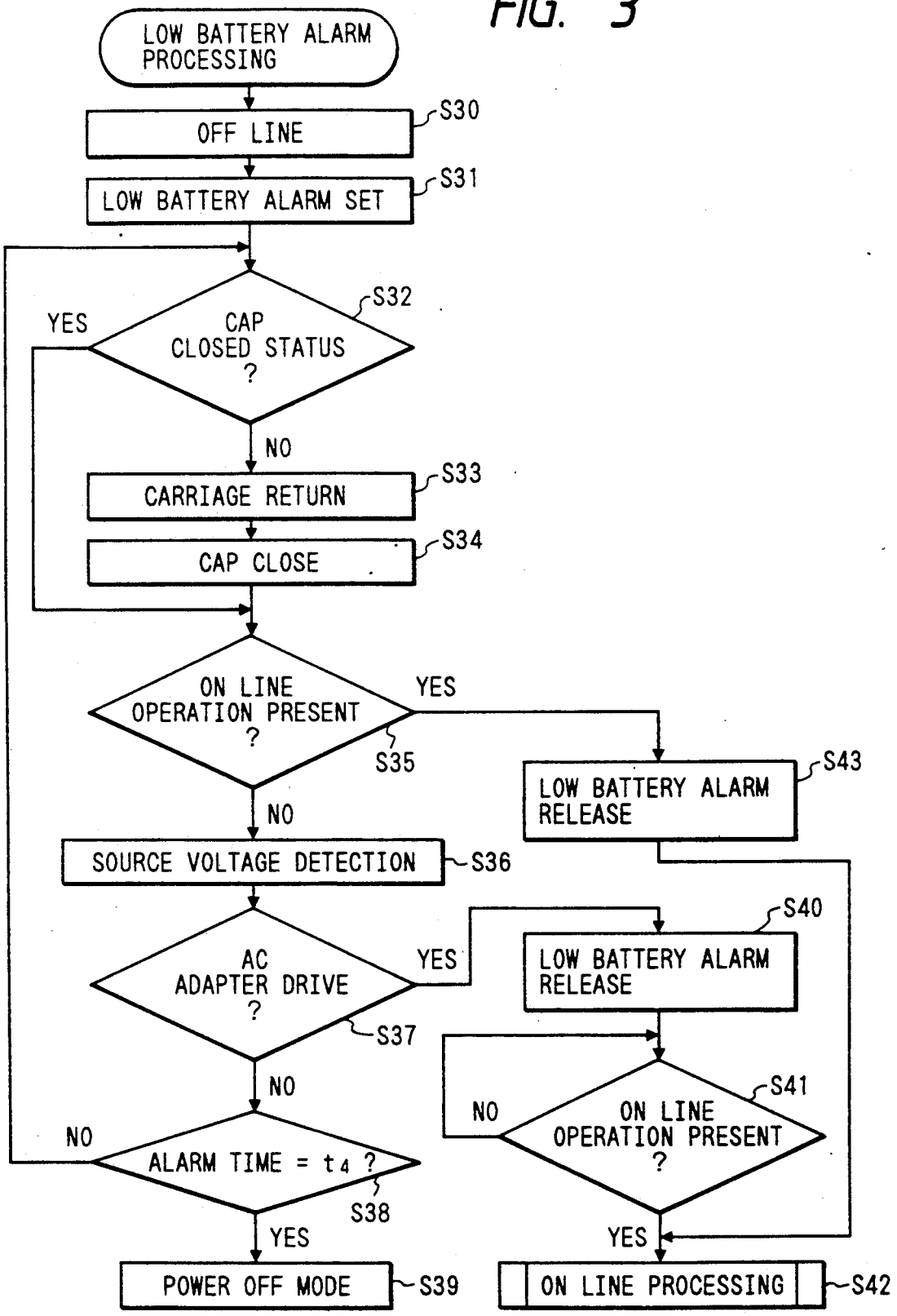

FIG. 3 is a flowchart showing go-down in battery capacity alarm processing procedure of the embodiment. As will be explained hereinlater, the go-down in battery capacity alarm processing is executed in the case where the go-down in battery capacity alarm flag has been set during the recording operation by the go-down in battery capacity alarm detection (FIG. 1B).

In FIG. 3, the recording apparatus is set into the off-line state in step S30. In the next step S31, the interruption processing of a switch other than the power switch and the on-line switch of the console 6 (FIG. 8) is inhibited and the go-down in battery capacity alarm display state is indicated by the LED lamp, buzzer, or the like. The go-down in battery capacity alarm state is released by either one of the three kinds of methods: (1) the power source is turned off by operating the power switch; (2) the AC adapter is connected and the regular electric power is supplied to the recording apparatus; and (3) the on-line operation is executed and the recording operation is restarted for a period of time when the go-down in battery capacity alarm flag or the go-down in battery capacity error flag is set.

In step S31, the go-down in battery capacity alarm state is set. After that, in step S32, if the carriage 5014 exists at the home position and the ink discharge port has been sealed and closed by the cap member, the processing routine advances to step S35.

If NO in step S32, step S33 follows and the carriage 5014 is returned to the home position. After that, the ink discharge port surface of the recording head 12 is sealed and closed by the cap member 5022 in step S34. A check is now made in step S35 to see if the on-line operation has been performed by the operator or not. If YES in step S35, step S43 follows and the go-down in battery capacity alarm state which has been set in step S31 is released and the go-down in battery capacity alarm flag is reset. After that, the on-line processing in FIG. 6 is performed in step S42. If NO in step S35, step S36 follows and a check is always made to see if the AC adapter had been connected to the recording apparatus by the operator and the electric power has been supplied from the AC adapter or not.

In the case where the electric power has been supplied from the AC adapter, the processing routine advances from step S37 to step S40 and the go-down in battery capacity alarm state which has been set in step S30 is released. The go-down in battery capacity alarm flag is also reset and the apparatus is set into the ordinary off-line standby mode. The recording data which had been received so far from the host computer before the go-down in battery capacity alarm state is set has been stored and held in the RAM 3 (FIG. 8). Therefore, by executing the on-line operation in step S41 and the on-line processing (refer to FIG. 7) in step S42, the recording operation is restarted on the basis of the recording data stored and the on-line control with the host computer can be performed.

On the other hand, in step S38, if the AC adapter is not connected within a time $t_4$ (e.g., $t_4 = 30$ minutes) after the go-down in battery capacity alarm state was set, the apparatus is set into the power-off mode in step S39.

A processing of the go-down in battery capacity detection and processings after completion of the go-down in battery capacity detection in the embodiment will now be described in accordance with the actual recording operation procedure.

Figure 4:
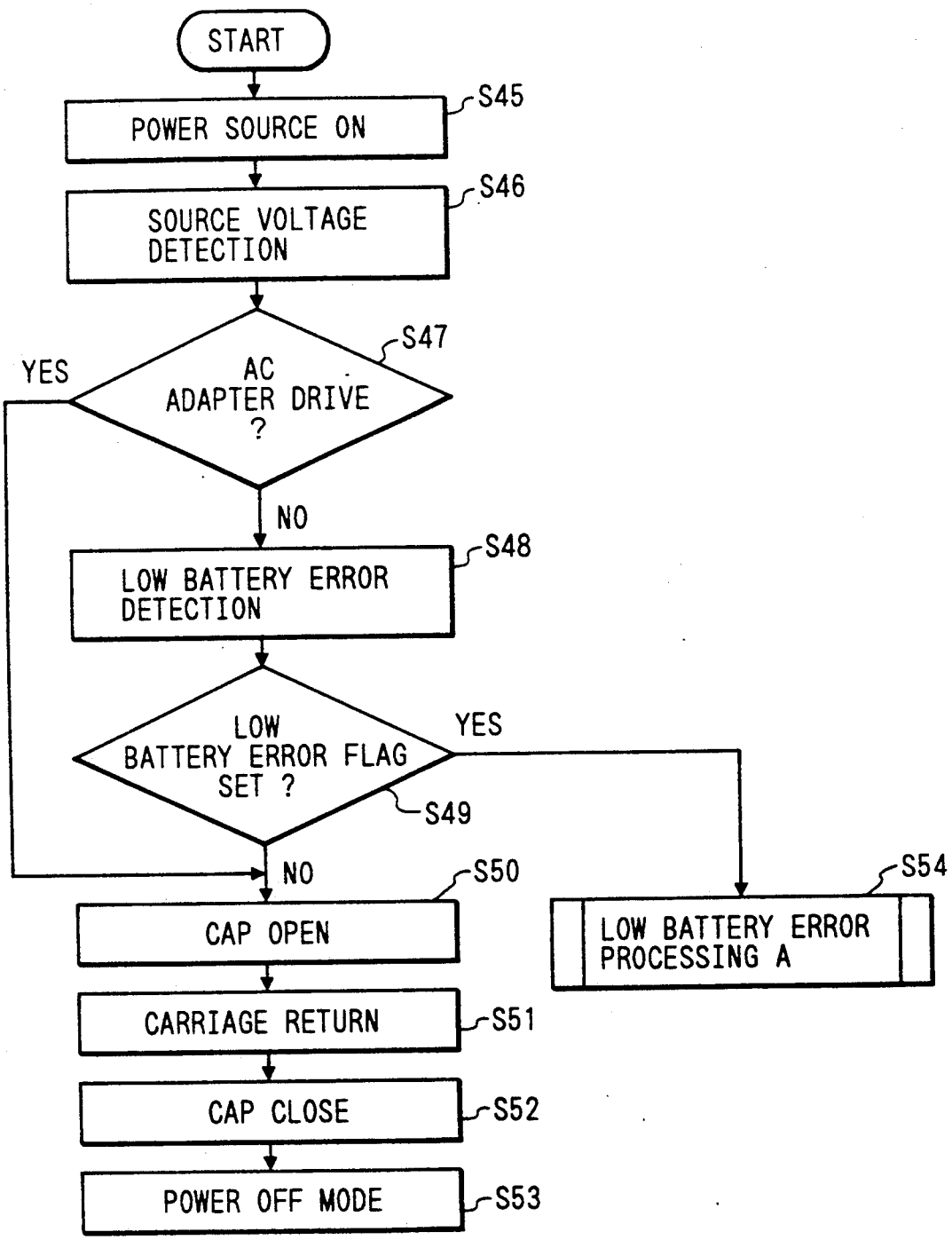
FIG. 4 is a flowchart showing the operation when a power source is turned on according to the embodiment.

FIG. 4 is a flowchart showing the operation when the power source of the ink jet recording apparatus according to the embodiment has been turned on. In the ink jet recording apparatus of the embodiment, each time the power source is turned on, the carriage 5014 and the cap member 5022 are driven in accordance with the power-off sequence, thereby capping the ink discharge port. The power-off sequence denotes the protecting operation to the recording head which is executed in a manner such that when the driving of the recording apparatus is stopped in a state in which the recording head 12 is not capped due to the cause such as a power failure or the like and the recording apparatus is recovered from the power failure state after a little while, the capping operation is automatically executed to thereby avoid a situation such that the ink discharge port of the recording head 12 is left in a state in which the ink discharge port is opened toward the atmosphere.

In FIG. 4, if the electric power has been supplied to the recording apparatus from the AC adapter or the battery in step S45, the source voltage is detected in step S46. A check is made in step S47 to see if the driving power source apparatus of the recording apparatus is the battery or the AC adapter. In the case of the AC adapter, the ordinary capping operation is executed (steps S50 to S52). After that, the power-off mode is set (step S53). In the case of the battery driving, the go-down in battery capacity error detection shown in FIG. 1A is executed (step S48) before the capping operation is performed. If it is determined in step S49 that the go-down in battery capacity error flag is not set in the go-down in battery capacity error detection, that is, there is an enough residual battery capacity to perform the capping operation, the processing routine advances to the next steps and the capping operation is executed and the power-off mode is set (steps S50 to S53).

On the other hand, if the go-down in battery capacity error flag has been set as a result of the go-down in battery capacity error detection, that is, it is decided that there is no residual battery capacity enough to perform the capping operation, step S54 follows and the go-down in battery capacity error processing A (FIG. 2A) is executed. By entering the power-off mode by jumping the capping process, the cap opening process is not executed, thereby preventing a situation such that the ink discharge port is left without being sealed and closed.

The power source is turned on in step S45 by inserting a power source jack in the case of the AC adapter and by turning on a switch (not shown) in the case of the battery.

FIG. 5 is a flowchart showing an example of the power-on/off operation procedure of the ink jet recording apparatus of the embodiment. In the diagram, when an interruption request has been supplied to the MPU 2 by operating the power switch in step S56, the MPU 2 turns off the power source if the recording apparatus is in the power-on mode when the power switch is operated. The MPU 2 turns on the power source if the recording apparatus is in the power-off mode.

The power-off operation procedure will be first explained hereinbelow. The power-on operation procedure will be subsequently described.

In FIG. 5, if NO In step S57, step S58 follows and the power-off operation is started. In step S58, a check is made to see if the ink discharge port of the recording head 12 has been sealed and closed by the cap member 5022 or not. For instance, in the case where the power source has been turned off in a state in which the recording head 12 had been capped such as in the case of the standby mode, the result in step S58 is YES and the processing routine advances to step S59. In step S59, the input source voltage which is applied to the recording apparatus is detected. In the next step S60, a check is made to see if the driving power source apparatus of the recording apparatus is the AC adapter (YES) or the battery (NO). The processing steps S62 and S63 are the same as the processing steps S22 and S23 in FIG. 2B described before. If NO in step S60, step S61 follows. If YES in step S60, the cap closing process in steps S64 to S66 is executed and the power-off mode is set (step S67).

In step S61, a check is made to see if the low battery error flag has been set or not. If YES, step S68 follows and the power-off mode is set without driving the cap member 5022 by the go-down in battery capacity error processing A type in FIG. 2A. On the other hand, if NO in step S61, the go-down in battery capacity error detection (step S62) in FIG. 1A is executed. If the go-down in battery capacity error flag has been set in step S63, the power-off mode is set in step S68 without executing the cap opening process. If NO in step S63, the capping operation is executed in steps S64 to S67 and the power-off mode is set.

In step S58, if the power-off operation has been performed in a state in which, for instance, the recording head 12 doesn't exist at the home position and the cap is opened as in the case during the recording operation, the processing routine advances to steps S65 to S67. Due to this, the carriage 5014 is returned to the home position and the recording head 12 is sealed and closed by the cap member 5022 and, after that, the power-off mode is set.

The power-on operation procedure will now be explained. In FIG. 5, if YES in step S57, step S74 follows and the power-on mode is set. The power-on operation is started.

In step S75, as an initialization upon power-on, in the hardware, input/output ports of the PPI 1 are initialized, the operation of the RAM 3 is checked, the RAM 3 is initialized, and the operation of the control ROM 5 is checked. In the software, parameters and flags which are used in the respective processings are initialized.

In steps S77 and S78, the source voltage is detected by the same method as that in steps S22 and S23 in FIG. 2B mentioned above, thereby discriminating whether the driving power source apparatus is the battery or the AC adapter. In the case of the AC adapter (YES), the processing routine advances to step S81 by jumping a series of go-down in battery capacity error procedures (steps S78 to S80). In the case of the battery (NO), the go-down in battery capacity error detection shown in FIG. 1A is executed (step S78). The carriage motor 8 is pseudo-excited as mentioned above and the battery capacity is discriminated.

If the go-down battery capacity error flag has been set, the result of step S79 is YES and the control of the go-down in battery capacity error processing B type shown in FIG. 2B is executed without performing the cap opening process (step S80). In step S80, the AC adapter is connected during the display of the go-down in battery capacity error as mentioned above and the on-line operation is executed, so that the error state is released and the processing routine advances to the next step. However, if the apparatus is left in the error state, the power-on mode is set after the elapse of a predetermined time.

On the other hand, if NO in step S79, the processing routine advances to step S81 by jumping the go-down in battery capacity error processing B in step S80.

As mentioned above, if the AC adapter is used as a driving power source apparatus or if it is determined that the battery capacity has a value enough to assure the operation of the recording apparatus, the cap opening process (step S81) is executed. After that, the carriage motor 8 is driven and the carriage 5014 is initialized to the home position (step S82). The cap closing process (step S83) is performed. In the next step S84, a check is made by the sheet sensor 9 to see if the sheet has been set into the recording apparatus or not. If YES, the apparatus is set into a mode such that the recording data from the host computer cam be received (on-line) (step S85). If NO in step S84, a no sheet error is decided (step S86). In the no sheet error state, the on-line operation is made invalid. The error state is released when the sheet is set. The operating mode can be shifted to the on-line state by the on-line operation, which will be explained hereinlater.

FIG. 6 is a flowchart showing an example of the recording operation procedure in the embodiment. In the recording operation when the apparatus is driven by the battery, the go-down in battery capacity error detection (FIG. 1A) is executed just before the cap opening process is executed when the recording operation is started on the basis of the recording data from the host computer. Further, each time one line is recorded by scanning the carriage, the go-down in battery capacity alarm detection (FIG. 1B) is performed at a deceleration driving timing of the carriage. If it is decided that the battery capacity is insufficient by each of the detecting procedures, the received recording data and the recording head are protected by the procedure of the go-down in battery capacity error processing B (FIG. 2B) in the former case and by the procedure of the go-down in battery capacity alarm processing (FIG. 3) in the latter case.

In FIG. 6, in step S100, a check is made to see if the recording start information has been sent from the host computer or not. If NO the processing routine advances to step S120 and subsequent steps. The apparatus waits until the recording data is received in a state in which the ink discharge port has been sealed and closed by the cap member 5022 (steps S120 to S122). If YES in step S100, the recording operation is started by the procedure in step S101 and subsequent steps.

A check is made in step S101 to see if the ink discharge port has been sealed and closed by the cap member or not. If NO, step S109 follows and the carriage motor 8 is driven and the movement of the carriage from the home position is started. If YES in step S101, a check is made to see if the apparatus is driven by the battery or the AC adapter in steps S102 to S103. If the apparatus is driven by the AC adapter, the processing routine advances to step S108. If the apparatus is driven by the battery, step S104 follows and a check is made to see if the driving of the sheet feed motor 10 has been finished or not. If YES, the go-down in battery capacity error detection (FIG. 1A) is performed in step S105. This is because in the case where the pseudo excitation processing of the motor and the driving of the sheet feed motor overlap, a situation such that the discharge current in the go-down in battery capacity error detection is deviated from the design value and the detection accuracy is deteriorated is prevented.

A check is made in step S106 to see if the go-down in battery capacity error flag in the go-down in battery capacity error detected in step S105 has been set or not. If NO in step S106, the processing routine advances to step S108 and the cap opening process is executed. After that, the driving of the carriage 5014 is started. On the other hand, if YES in step S106, the cap opening process is not performed and the go-down in battery capacity error processing B (FIG. 2B) to protect the recording apparatus is executed in step S107.

If it is determined that the battery capacity is sufficient in the discriminating step of the driving power source apparatus before the recording operation is started, the ink droplet is discharged onto the recording sheet and the recording of an image is started. The driving of the carriage 5014 is started in step S109. After completion of the recording of the image of one line in step S110, a check is made to see if the apparatus is driven by the battery or the AC adapter in steps S111 to S112. If the apparatus is driven by the AC adapter, the carriage motor 8 is decelerated in step S113 and the driving of the carriage motor 8 is finished in step S114. If the apparatus is driven by the battery, step S119 follows and the deceleration driving of the carriage motor 8 is started in accordance with the go-down in battery capacity alarm detection procedure shown in FIG. 1B and the battery capacity is detected.

After completion of the driving of the carriage motor 8 (step S114) after the end of the processing in step S119, a check is made in step S115 to see if the low battery alarm flag has been set or not. If NO in step S115, step S117 follows. If YES, the recording apparatus is protected in accordance with the go-down in battery capacity alarm procedure shown in FIG. 3 in step S116.

After completion of the image recording procedure of one line, a check is made in step S117 to see if the recording sheet has been set or not. If NO, the no sheet error is determined (step S118). If YES, the processing routine is returned to step S100 and the operation procedure described above is repeated on the basis of the recording data.

FIG. 7 is a flowchart showing an example of the operation procedure by the on-line processing according to the embodiment. In the ordinary on-line processing, the recording apparatus is switched from the off-line (non-line) state to the on-line (line) state. The cap opening process and the initialization of the carriage position are further executed to start the recording operation. On the other hand, in the ink jet recording apparatus of the embodiment, for the purpose of protection of the recording apparatus, the on-line processing is controlled on the basis of the result of the detection of the battery capacity in the case of the battery driving.

In FIG. 7, a check is made in step S88 to see if the recording sheet has been set in the apparatus or not. If NO, no sheet error is decided (step S98) and the on-line operation is made invalid. On the contrary, if YES in step S88, the on-line processing in step S89 and subsequent steps is executed. In steps S89 to S90, a check is made to see if the apparatus is driven by the battery or the AC adapter. In the case of the AC adapter driving, the ordinary on-line processing is performed because the go-down in battery capacity error control is unnecessary. In the case of the battery driving, the go-down in battery capacity error is detected (FIG. 1A) in step S91. If the go-down in battery capacity error flag has been set in step S92, the cap opening process is not performed and the go-down in battery capacity error processing B (FIG. 2B) is performed in step S93. If the go-down in battery capacity error flag is not set, the on-line processing in step S95 and subsequent steps is executed.

A check is made in step S94 to see if the power-on operation has been completed or not. If NO, the interrupted power-on operation is restarted. If YES, the cap opening process (step S95) and the initialization (step S96) of the carriage position are executed. After that, the interrupted processing is restarted at the time point of the off-line mode (step S97).

The case where the power-on operation is not finished in step S94 denotes a situation such that the processing in step S83 is not finished such as in the case where the power-on operation has been interrupted in the go-down in battery capacity error state by the go-down in battery capacity error control during the power-on operation described in FIG. 5 or the like. Therefore, if the on-line operation has been performed to restart the operation by connecting the AC adapter by the operator in the processing step S80, the result of step S94 is NO.

As described above, in the embodiment, since the battery capacity is detected during the deceleration driving of the carriage motor 8 in which the load is constant within the period of time of the recording operation, a throughput of the recording apparatus is not deteriorated and the battery capacity can be detected at a high precision. Consequently, since the limited battery capacity can be sufficiently used, the recording apparatus can be driven by the battery for a longer time.

According to the embodiment, the protection processing (capping) of the ink jet recording apparatus can be performed with certainty by the small battery capacity after the battery voltage has dropped to an end voltage. Therefore, even in the case where the battery capacity is completely depleted and the apparatus has stopped functioning inconveniences such as defective discharge of the recording head, corrosion of the apparatus due to a leakage of the ink, and the like can be avoided.

Furthermore, in the embodiment, the battery capacity is detected while applying a load to the carriage motor 8 by the pseudo excitation just before the opening of the cap from the ink discharge port which is executed at the start of the recording operation or the like. Therefore, the throughput of the recording apparatus is not deteriorated and the battery capacity can be detected with high precision. Due to this, since the limited battery capacity can be effectively used, the recording apparatus can be driven by the battery for a longer time.

On the other hand, according to the embodiment, since the capping operation (particularly, opening of the cap) is not executed in a state of the reduced battery capacity, even in the case, where the battery capacity has been completely depleted and the apparatus has stopped the functioning inconveniences such as defective discharge of the recording head, corrosion of the apparatus due to a leakage of the ink, and the like can be avoided.

A secondary battery such as a Ni-Cd battery or the like which can be repetitively used by changing can be also used as a battery. The recording apparatus of the invention can be also applied to an image output terminal of an information processing apparatus such as a computer or the like, a copying apparatus, and a facsimile apparatus.

As described above, according to the invention, the battery capacity can be detected with a high accuracy without deteriorating the throughput of the recording apparatus and the limited battery capacity can be effectively used.

The present invention brings about excellent effects particularly in a recording head and a recording device of the ink jet system using a thermal energy among the ink jet recording systems.

As to its representative construction and principle, for example, one practiced by use of the basic principle disclosed in, for instance, U.S. Pat. Nos. 4,723,129 and 4,740,796 is preferred. The above system is applicable to either one of the so-called on-demand type and the continuous type. Particularly, the case of the on-demand type is effective because, by applying at least one driving signal, which gives rapid temperature elevation exceeding nucleate boiling corresponding to the recording information on electrothermal converting elements arranged in a range corresponding to the sheet or liquid channels holding liquid (ink), a heat energy is generated by the electrothermal converting elements to effect film boiling on the heat acting surface of the recording head, and consequently the bubbles within the liquid (ink) can be formed in correspondence to the driving signals one by one. By discharging the liquid (ink) through a discharge port by growth and shrinkage of the bubble, at least one droplet is formed. By making the driving signals into pulse shapes, growth and shrinkage of the bubble can be effected instantly and adequately to accomplish more preferably discharging of the liquid (ink) particularly excellent in accordance with characteristics. As the driving signals of such pulse shapes, the signals as disclosed in U.S. Pat. Nos. 4,463,359 and 4,345,262 are suitable. Further excellent recording can be performed by using the conditions described in U.S. Pat. No. 4,313,124 of the invention concerning the temperature elevation rate of the above-mentioned heat acting surface.

As a construction of the recording head, in addition to the combined construction of a discharging orifice, a liquid channel, and an electrothermal converting element (linear liquid channel or right angle liquid channel) as disclosed in the above specifications, the construction by use of U.S. Pat. Nos. 4,558,333 and 4,459,600 disclosing the construction having the heat acting portion arranged in the flexed region is also included in the invention. The present invention can be also effectively constructed as disclosed in Japanese Laid-Open Patent Application No. 59-123670 which discloses the construction using a slit common to a plurality of electrothermal converting elements as a discharging portion of the electrothermal converting element or Japanese Laid-Open Patent Application No. 59-138461 which discloses the construction having the opening for absorbing a pressure wave of a heat energy corresponding to the discharging portion.

Further, as a recording head of the full line type having a length corresponding to the maximum width of a recording medium which can be recorded by the recording device, either the construction which satisfies its length by a combination of a plurality of recording heads as disclosed in the above specifications or the construction as a single recording head which has integratedly been formed can be used. The present invention can exhibit the effects as described above more effectively.

In addition, the invention is effective for a recording head of the freely exchangeable chip type which enables electrical connection to the main device or supply of ink from the main device by being mounted onto the main device, or for the case by use of a recording head of the cartridge type provided integratedly on the recording head itself.

It is also preferable to add a restoration means for the recording head, preliminary auxiliary means, and the like provided as a construction of the recording device of the invention because the effect of the invention can be further stabilized. Specific examples of them may include, for the recording head, capping means, cleaning means, pressurization or aspiration means, and electrothermal converting elements or another heating element or preliminary heating means according to a combination of them. It is also effective for performing a stable recording to realize the preliminary mode which executes the discharging separately from the recording.

As a recording mode of the recording device, further, the invention is extremely effective for not only the recording mode of only a primary color such as black or the like but also a device having at least one of a plurality of different colors or a full color by color mixing, depending on whether the recording head may be either integratedly constructed or combined in plural number.

We claim:

1. An ink jet recording apparatus to which power is supplied from a battery and which records onto a recording medium by using a recording head which discharges ink from a discharge port, comprising:

battery detecting means for detecting run-down in battery capacity of the battery on the basis of a voltage of the battery;

capping means for capping the discharge port of the recording head;

load control means for applying a load to the battery for a predetermined period of time just before the capping means cancels the capping of the discharge port of the recording head; and detection control means for allowing the battery detecting means to execute the voltage detection for said predetermined period of time.

2. An apparatus according to claim 1, further comprising a motor for relatively moving the recording head and the recording medium; and wherein the load control means applies the load to the battery by supplying the power from the battery to the motor for said predetermined period of time.

3. An apparatus according to claim 2, wherein the motor is a stepping type motor and the load control means applies the load to the battery by pseudo exciting the motor for the predetermined period of time.

4. An apparatus according to claim 2, further comprising cap control means for inhibiting the capping means from releasing the capping of the discharge port of the recording head when the run-down in battery capacity of the battery has been detected by the battery detecting means.

5. An apparatus according to claim 1, further comprising:

a terminal to which an AC adapter can be connected; and switching means for switching the power which is supplied from the battery and power which is supplied from the AC adapter connected to said terminal and for supplying the power to said apparatus.

6. An apparatus according to claim 5, wherein the switching means preferentially selects the power from the AC adapter.

7. An apparatus according to claim 6, wherein a voltage of the power which is supplied from the battery differs from a voltage of the power. which is supplied from the AC adapter.

8. An apparatus according to claim 7, further comprising power source detecting means for detecting that the AC adapter has been connected to the terminal on the basis of the voltage of the power which is supplied from the switching means.

9. An apparatus according to claim 8, wherein the battery detecting means ceases battery capacity detection when the connection of the AC adapter has been detected by the power source detecting means.

10. An apparatus according to claim 1, wherein the battery comprises a secondary chargeable battery.

11. An apparatus according to claim 1, wherein the recording head has heat energy generating means which is arranged in the discharge port and causes a state change in the ink by heat and discharges the ink from the discharge port on the basis of said state change, thereby forming a flying liquid droplet.

12. A recording apparatus for recording by driving a driving load by supplying a power from battery, comprising:

detecting means for detecting a capacity of the battery;

drive control means for driving the driving load for a predetermined period of time just before recording operation; and detection control means for allowing the detecting means to detect the capacity for said predetermined period of time.

13. An ink jet recording apparatus which has a recording head for recording by discharging ink from a discharge port to a recording medium and protecting means for capping the discharge port of the recording head and executes an operation by supplying a power source from a battery, comprising:

detecting means for detecting a capacity of the battery;

load control means for applying a load to the battery for a predetermined period of time just before the capping of the discharge port of the recording head by the protecting means is released; and detection control means for allowing the detecting means to detect the capacity for said predetermined period of time.

14. An apparatus according to claim 13, wherein the detecting means detects the capacity on the basis of the voltage of the battery.

15. An apparatus according to claim 13, further having protection control means for controlling a protecting operation of the protecting means on the basis of a result of the capacity detection of the detecting means.

16. An apparatus according to claim 13, wherein the protecting means is a cap.

17. An apparatus according to claim 13, wherein the recording head has heat energy generating means which is arranged in the discharge port and causes a state change in the ink by heat and discharges the ink from the discharge port on the basis of the state change, thereby forming a flying liquid droplet.

18. A recording apparatus to which power is supplied from a battery and which records onto a recording medium by using a recording head, comprising:

battery detecting means for detecting run-down in battery capacity of the battery on the basis of a voltage of the battery;

a motor for relatively moving the recording head and the recording medium; and detection control means for allowing the battery detecting means to execute the voltage detection for an acceleration or deceleration period of time of the motor.

19. An apparatus according to claim 18, wherein the recording by the recording head is not executed for the acceleration or deceleration period of time.

20. An apparatus according to claim 18, wherein the recording head discharges ink from a discharge port.

21. An apparatus according to claim 20, further comprising capping means for capping the discharge port of the recording head.

22. An apparatus according to claim 21, further comprising cap control means for allowing the capping means to cap- the discharge port of the recording head when the run-down in battery capacity of the battery has been detected by the battery detecting means.

23. An apparatus according to claim 22, further comprising means for ceasing battery capacity detection of the battery detecting means in accordance with a predetermined operation.

24. An apparatus according to claim 18, further comprising:

a terminal to which an AC adapter can be connected; and switching means for switching the power which is supplied from the battery and power which is supplied from the AC adapter connected to said terminal and for supplying the power to said apparatus.

25. An apparatus according to claim 24, wherein the switching means preferentially selects the power from the AC adapter.

26. An apparatus according to claim 25, wherein a voltage of the power which is supplied from the battery differs from a voltage of the power which is supplied from the AC adapter.

27. An apparatus according to claim 26, further comprising power source detecting means for detecting that the AC adapter has been connected to the terminal on the basis of the voltage of the power which is supplied from the switching means.

28. An apparatus according to claim 27, wherein the battery detecting means ceases battery capacity detection when the connection of the AC adapter has been detected by the power source detecting means.

29. An apparatus according to claim 18, wherein the battery comprises a secondary chargeable battery.

30. An apparatus according to claim 20, wherein the recording head has heat energy generating means which is arranged in the discharge port and causes a state change in the ink by heat and discharges the ink from the discharge port on the basis of said state change, thereby forming a flying liquid droplet.

31. A recording apparatus which executes recording by driving a driving load by supplying power from a battery, comprising:

detecting means for detecting a capacity of the battery; and detection control means for allowing the detecting means to execute the detection of the capacity synchronously with a special operation of the driving load in a recording operation period of time.

32. An apparatus according to claim 31, wherein the driving load includes:

a recording head for performing the recording by discharging ink from a discharge port to a recording medium; and a motor for relatively moving the recording head and the recording medium.

33. An apparatus according to claim 32, wherein the detecting means detects the capacity of the battery on the basis of a voltage of the battery.

34. An apparatus according to claim 32, wherein the detection control means allows the detecting means to execute the capacity detection synchronously with a special operation of the motor in the recording operation period of time.

35. An apparatus according to claim 32, further having:

protecting means for capping the discharge port of the recording head; and protection control means for controlling a protecting operation of the protecting means on the basis of a result of the capacity detection of the detecting means.

36. An apparatus according to claim 32, wherein the recording head has heat energy generating means which is arranged in the discharge port and causes a state change in the ink by heat and discharges the ink from the discharge port on the basis of said state change, thereby forming a flying liquid droplet.

37. An ink jet recording apparatus to which power is supplied from a battery and which executes recording onto a recording medium by using a recording head for discharging ink from a discharge port, comprising:

battery detecting means for detecting run-down in battery capacity of the battery on the basis of a voltage of the battery;

capping means for capping the discharge port of the recording head;

load control means for applying a load to the battery for a predetermined period of time just before the capping means releases the capping of the discharge port of the recording head;

first detection control means for allowing the battery detecting means to execute a voltage detection for said predetermined period of time;

a motor for relatively moving the recording head and the recording medium; and second detection control means for allowing the battery detecting means to execute the voltage detection for an acceleration or deceleration period of time of the motor.

38. An apparatus according to claim 37, wherein the load control means applies a load to the battery by supplying the power from the battery to the motor for said predetermined period of time.

39. An apparatus according to claim 37, further comprising:

cap control means for inhibiting that the capping means releases the capping of the discharge port of the recording head when the run-down in battery capacity of the battery has been detected by the battery detecting means on the basis of the first detection control means.

40. An apparatus according to claim 37, further comprising:

cap control means for allowing the capping means to cap the discharge port of the recording head when the run-down in battery capacity of the has been detected by the battery detecting means on the basis of the second detection control means.

41. An apparatus according to claim 37, further comprising:

a terminal to which an AC adapter can be connected; and switching means for switching the power which is supplied from the battery and power which is supplied from the AC adapter connected to said terminal and for supplying the power to said apparatus.

42. An apparatus according to claim 41, wherein the switching means preferentially selects the power from the AC adapter.

43. An apparatus according to claim 42, wherein a voltage of the power which is supplied from the battery differs from a voltage of the power which is supplied from the AC adapter.

44. An apparatus according to claim 43, further comprising power source detecting means for detecting that the AC adapter has been connected to the terminal on the basis of the voltage of the power which is supplied from the switching means.

45. An apparatus according to claim 44, wherein the battery detecting means ceases battery capacity detection when the connection of the AC adapter has been detected by the power source detecting means.

46. An apparatus according to claim 37, wherein the battery comprises a secondary chargeable battery.

47. An apparatus according to claim 37, wherein the recording head has heat energy generating means which is arranged in the discharge port and causes a state change in the ink by heat and discharges the ink from the discharge port on the basis of said state change, thereby forming a flying liquid droplet.

48. An ink jet recording method of executing recording while relatively moving a recording head to which power is supplied form a battery and which discharges ink from a discharge port to a recording medium, comprising the steps of:

detecting run-down in battery capacity of the battery on the basis of a voltage of the battery while applying a load to the battery for a predetermined period of time before the recording is started;

opening a cap which covers the discharge port of the recording head when the run-down in battery capacity is not detected, thereby executing a recording operation; and inhibiting the cap which covers the discharge port of the recording head from opening when the run-down in battery capacity has been detected.

49. A method according to claim 48, further comprising the steps of:

detecting the run-down in battery capacity of the battery on the basis of the voltage of the battery for a start or end period of a time of the relative movement of the recording head during the recording operation;

continuing the recording operation when the run-down in battery capacity is not detected; and covering the discharge port of the recording head with the cap when the run-down in battery capacity has been detected.

50. A method according to claim 48, wherein the recording head has heat energy generating means which is arranged in the discharge port and causes a state change in the ink by heat and discharges the ink from the discharge port on the basis of said state change, thereby forming a flying liquid droplet.

* * * * *

UNITED STATES PATENT AND TRADEMARK OFFICE

CERTIFICATE OF CORRECTION

PATENT NO. : 5,182,583

DATED : January 26, 1993

INVENTOR(S) : Hideo Horigome, et al

It is certified that error appears in the above-indentified patent and that said Letters Patent is hereby corrected as shown below:

COLUMN 4:

Line 60, "onto," should read --onto--;

Line 62, "charge" should read --charges--.

Figure 5B:
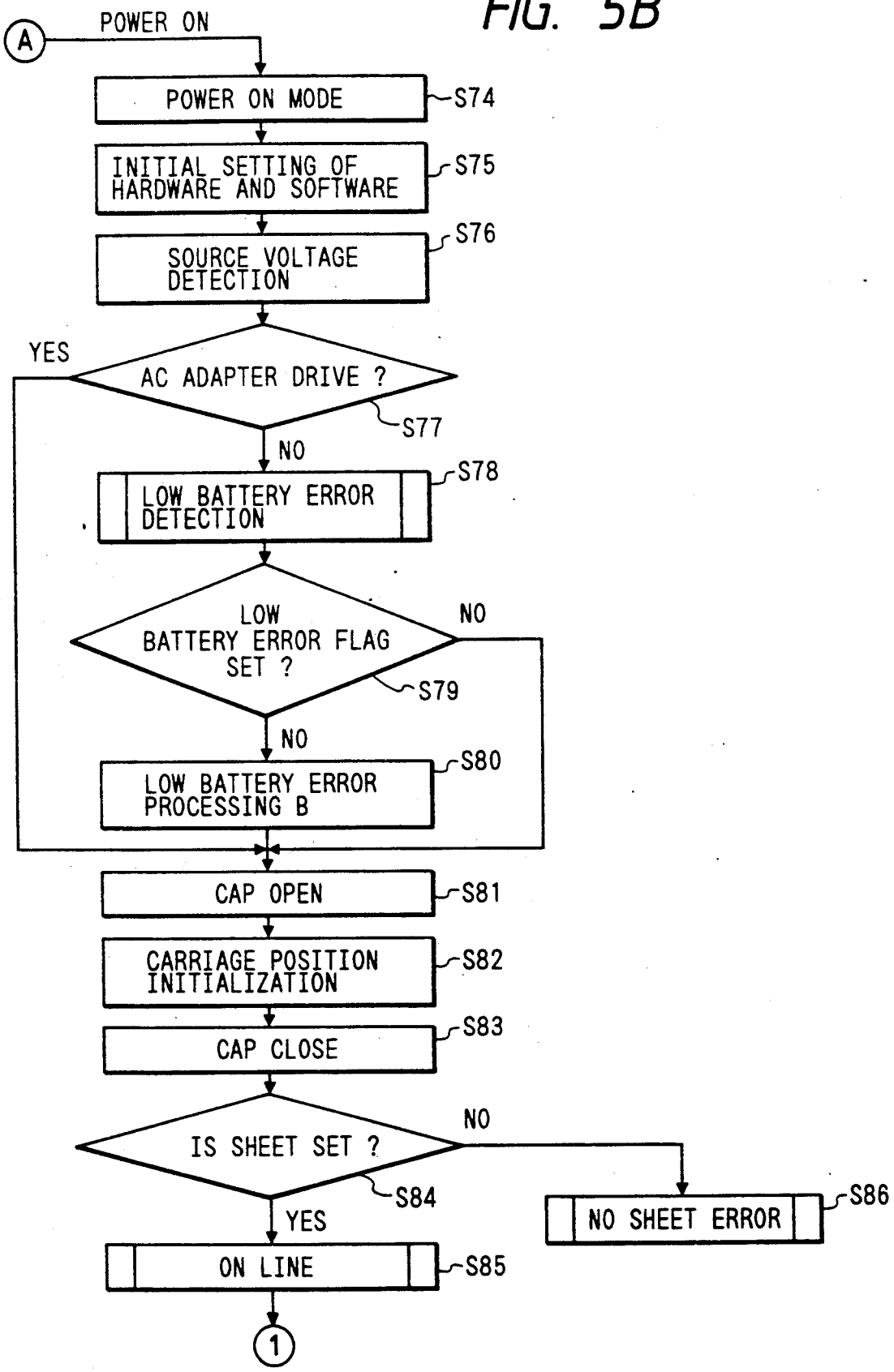

COLUMN 5:

Line 12, "an embodiment" should read --a recording apparatus--; "a" should read --an--;

Line 13, "recording apparatus" should read --embodiment--;

Line 20, "FIG. 5, 5A and 5B" should read --FIGS. 5, 5A and 5B--.

UNITED STATES PATENT AND TRADEMARK OFFICE

CERTIFICATE OF CORRECTION

PATENT NO. : 5,182,583

DATED : January 26, 1993

INVENTOR(S) : Hideo HORIGOME, et al.

It is certified that error appears in the above-indentified patent and that said Letters Patent is hereby corrected as shown below:

COLUMN 6:

Line 32, "a" and "source" (first occurrence) should be deleted;

Line 60, "forward-" should read --forward--.

COLUMN 8:

Line 43, "herein-below" should read --hereinbelow--;

Line 61, "be ore" should read --before--.

COLUMN 9:

Line 4, "capacity,," should read --capacity--.

COLUMN 14:

Line 51, "In" (second occurrence) should read --in--.

UNITED STATES PATENT AND TRADEMARK OFFICE

CERTIFICATE OF CORRECTION

PATENT NO. : 5,182,583

DATED : January 26, 1993

INVENTOR(S) : Hideo HORIGOME, et al.

It is certified that error appears in the above-indentified patent and that said Letters Patent is hereby corrected as shown below:

COLUMN 18:

Line 28, "functioning" should read --functioning,--;

Line 45, "case," should read --case--;

Line 47, "the functioning" should read --functioning,--;

Line 59, "a" should be deleted.

COLUMN 20:

Line 43, "claim 2" should read --claim 1--;

Line 62, "power." should read --power--.

COLUMN 21:

Line 14, "a" should be deleted; "from" should read --from a--;

Line 28, "a" should be deleted;

Line 29, "source" should be deleted.

UNITED STATES PATENT AND TRADEMARK OFFICE

CERTIFICATE OF CORRECTION

PATENT NO. : 5,182,583 Page 4 of 4

DATED : January 26, 1993

INVENTOR(S) : Hideo HORIGOME, et al.

It is certified that error appears in the above-indentified patent and that said Letters Patent is hereby corrected as shown below:

COLUMN 22:

Line 8, "cap-" should read --cap--.

COLUMN 23:

Line 56, "the" (second occurrence) should read --the battery--.

Signed and Sealed this

Twenty-second Day of March, 1994

Bruce Lehman

*Attest:*

BRUCE LEHMAN

*Attesting Officer*

*Commissioner of Patents and Trademarks*